US006579391B1

(12) United States Patent
Shiffler et al.

(10) Patent No.: US 6,579,391 B1
(45) Date of Patent: Jun. 17, 2003

(54) METHOD FOR FOAM BONDING OF SPUNLACE FABRIC TO PRODUCE ENHANCED FABRIC CHARACTERISTICS

(75) Inventors: Donald A. Shiffler, Kinston, NC (US); Amit Shahani, Raleigh, NC (US); Thomas F. Gilmore, deceased, late of Raleigh, NC (US), by Kerry L. Gilmore, legal representative executor

(73) Assignee: North Carolina State University, Raleigh, NC (US)

( * ) Notice: Subject to any disclaimer, the term of this patent is extended or adjusted under 35 U.S.C. 154(b) by 0 days.

(21) Appl. No.: 09/232,347

(22) Filed: Jan. 15, 1999

(51) Int. Cl.[7] ..... D04H 5/02; D04H 5/04; D04H 1/48

(52) U.S. Cl. ..... 156/78; 156/148; 156/181; 204/109; 28/104

(58) Field of Search ..... 156/148, 181, 156/78; 28/103, 104; 264/109; 427/421, 424

(56) References Cited

U.S. PATENT DOCUMENTS 4,199,644 A * 4/1980 Platt ..... 428/300
4,416,936 A * 11/1983 Erickson et al. ..... 428/286
4,499,139 A 2/1985 Schortmann
4,562,097 A * 12/1985 Wlater et al. ..... 427/209
4,623,575 A 11/1986 Brooks et al.
5,009,747 A 4/1991 Viazmensky et al.
5,252,386 A * 10/1993 Hughes et al. ..... 428/224
5,311,389 A * 5/1994 Howey ..... 360/133
5,405,650 A * 4/1995 Boulanger et al. ..... 427/261
5,475,903 A * 12/1995 Collins ..... 28/104
5,895,623 A * 4/1999 Trokhan et al. ..... 264/504

* cited by examiner

*Primary Examiner*—Sam Chuan Yao
(74) *Attorney, Agent, or Firm*—Jenkins & Wilson, P.A.

(57) ABSTRACT

A method for hydroentangling a nonwoven web to increase the strength and abrasion resistance while maintaining highly desirable hand and drape characteristics. The method provides for carding and cross-lapping synthetic and/or natural fibers so as to form a desired substrate. The substrate is then hydroentangled under relatively low pressure to form a desired spunlace web, and a relatively low amount of a foam adhesive latex binding material is applied to the spunlace web. Thereafter, a force is applied to the foamed spunlace web so as to cause the foamed binding material to fully penetrate the spunlace web from face to back. The resulting hydroentangled (spunlace) nonwoven web provides an enhanced balance of tensile properties, abrasion resistance, and fabric aesthetics.

20 Claims, 23 Drawing Sheets

Foam Applicator Mechanism

Foam Applicator Mechanism

METHOD FOR FOAM BONDING OF SPUNLACE FABRIC TO PRODUCE ENHANCED FABRIC CHARACTERISTICS

TECHNICAL FIELD

The present invention relates to hydroentangled (spunlace) nonwoven fabric, and more particularly, the invention relates to an improved method for foam bonding of hydroentangled (spunlace) nonwoven fabric.

RELATED ART

In the 1970s a considerable amount of work was done in the area of latex addition to bond spunlace fabrics. DuPont investigated resin treatment of SONTARA® (100% polyester spunlaced fabric). DuPont developed an apparatus for measuring the resistance to disentanglement of spunlace fabric in 1979. DuPont further discovered one series of spunlace fabrics treated with 30% soft acrylic latex (by padding) which (1) showed no signs of disentanglement after 200 cycles on their instrument and (2) withstood five laundering cycles. The fabrics were subsequently re-tested after laundering and had similar excellent results. DuPont reported that their fabrics had "a crisper hand" as a result of treatment. Burlington Formed Fabrics Division of Burlington Industries, Inc. reported the use of latex in stabilizing their NEXUS® spunlace fabrics. They reported their fabrics to have better pilling resistance and durability, but at the expense of increased stiffness.

In 1986 Chicopee patented a process (see U.S. Pat. No. 4,623,575) to make food service wipes which were made by low specific energy hydroentangling followed by dry print bonding. Normally, in print bonding the fabric is prewetted and then the binder is applied in the wet state. This is then followed by drying. In the case of dry print bonding, the fabric is dried after prewetting and then the binder is applied. The resulting fabric has a good combination of strength, softness and durability. U.S. Pat. No. 5,009,747 issued to The Dexter Corporation in 1991 disclosing the addition of small amounts of latex to polyester/woodpulp hyrdroentangled fabrics. However, none of these patents disclosed the use of foam application as a method of bonding hydroentangled nonwoven fabrics.

U.S. Pat. No. 4,499,139 to The Kendall Company in 1985 discloses the use of latex foam (mixed with clay) to coat a single-ply hydroentangled fabric with a knife-over-roll applicator whereby the foam is worked into the only a portion of the fabric profile so as to leave the back surface free of foam binder. The patent discloses that the material has sufficient hydrophobicity to be a bacterial barrier while preserving comfort, drapeability, air permeability, flexibility and hand.

It is well known that a major drawback of spunlace (hydroentangled) nonwoven fabrics is that they disentangle easily and therefore lack abrasion resistance and have poor recovery from small strains. This is caused by the frictional nature of the hydroentangling process which does not have the locking characteristics of yam-based fabrics. This deficiency can be corrected by entangling the fabrics at high levels of specific energy (energy supplied to the hydroentangling jets) or by saturation bonding the fabrics with chemical binders. Both of these methods have well known disadvantages including that (1) high specific energy entangling increases production and filtration costs and (2) chemical binding at both high and low levels of saturation (dipping the entire nonwoven fabric into a latex bath) tends to make the spunlace nonwoven fabric stiffer and to cause the fabric to lose many of its desirable aesthetic properties such as good hand and drape.

The purpose of applicants' invention is to use a very low level (≦5% by weight) application of foamed acrylic latex binder to fully penetrate spunlaced cotton, acrylic, and/or polyester fabrics in such a manner as to reduce the loss of desirable properties while still improving fabric dimensional stability and abrasion resistance. Further, applicants believe that their novel process will work with a spunlace fabric formed from any staple fiber. Applicants have achieved the desired spunlace fabric characteristics through use of the novel foam binder application process technique described herein.

DISCLOSURE OF THE INVENTION

In accordance with the present invention, applicants provide a method of producing a hydroentangled nonwoven web material with good strength and abrasion resistance while maintaining good fabric aesthetics. The method comprises forming a substrate by carding and cross-lapping fibers wherein the fibers are synthetic and/or natural fibers. The substrate of fibers are then hydroentangled to form a spunlace web, and an effective amount of a foamed adhesive bonding material is then applied to the spunlace web. Next, a force is applied to the spunlace web to cause the foamed material to fully penetrate the spunlace web from front to back.

It is therefore an object of the present invention to provide an improved hydroentangled (spunlace) nonwoven fabric that possesses good strength and abrasion resistance characteristics while maintaining desirable fabric aesthetics such as hand and drape.

It is another object of the present invention to provide a method of treating a hydroentangled (spunlace) nonwoven fabric with a novel foamed acrylic latex binder application that reduces the loss of desirable fabric qualities such as good strength and abrasion resistance while simultaneously maintaining good fabric aesthetics such as hand and drape.

Some of the objects of the invention having been stated hereinabove, other objects will become evident as the description proceeds, when taken in connection with the accompanying drawings as best described hereinbelow.

BRIEF DESCRIPTION OF THE DRAWINGS

FIG. 20 is a graph illustrating a typical stress/strain curve for an all polyester hydroentangled (spunlace) nonwoven fabric produced at 1800 kJ/kg hydroentangling energy and 2.5% foamed binder add-on;

BEST MODE FOR CARRYING OUT THE INVENTION

Applicants have discovered that strength, abrasion resistance, load at 5% strain (modulus), and strain recovery of dry lay spunlace nonwoven fabric are improved by the addition of small amounts (≦5% by weight) of acrylic latex binder in the form of a collapsible foam in accordance with the present invention, and that bending rigidity is only somewhat increased.

By way of background, applicants note that spunlace (hydroentangled) nonwoven fabrics provide a good balance of aesthetics and performance. However, fibers in spunlace (hydroentangled) nonwoven fabrics are relatively easy to disentangle because of the frictional nature of the fiber bonding. Therefore, these fabrics have weak abrasion resistance, relatively low modulus, and poor recovery from the small strains encountered in fabric processing to finished goods. This can be corrected by entangling the fabrics at high levels of specific energy or by saturation bonding the fabrics with chemical binders. Both of these methods have their disadvantages. High specific energy increases nonwoven fabric production and filtration costs, and chemical binding at both high and low levels of saturation (dipping the entire nonwoven fabric into a latex bath) yields significantly stiffer fabric causing loss of hand and drape.

Applicants have discovered that very low levels (≦5% by weight) of acrylic latex binder applied as a foam to hydroentangled, carded, and cross-lapped fabric formed of cotton, acrylic, and/or polyester yarn produces an improved balance of tensile properties, abrasion resistance, and fabric aesthetics.

Applicants used two synthetic fibers, polyester and acrylic, and one natural fiber, cotton, to make a hydroentangled nonwoven fabric in accordance with the invention. Applicants, however, contemplate that other fibers (as well as selected blends of fibers) can be used and are intended to be within the scope of the inventive process described and claimed herein. The properties and suppliers of the three fibers used are listed in Table I below. Rohm and Haas binders RHOPLEX® NW-1715 and RHOPLEX® NW-1845 were used for latex foam bonding. The foaming agent was UNIFROTH 0144 supplied by Unichem Inc.

TABLE I

Fiber Properties

| SUPPLIER AND FIBER | FIBER LINEAR DENSITY, (dtex) | FIBER LENGTH, (mm) |
|---|---|---|
| Cotton Inc., Unbleached Cotton | 1.94 (5 micronaire) | 25.4 |
| Hoechst Celanese, Polyester Type 121 | 1.11 Round Cross Section | 38.1 |
| Cytec, Acrylic V97C Type V97C | 1.67 Round Cross Section | 38.1 |

Figure 1:
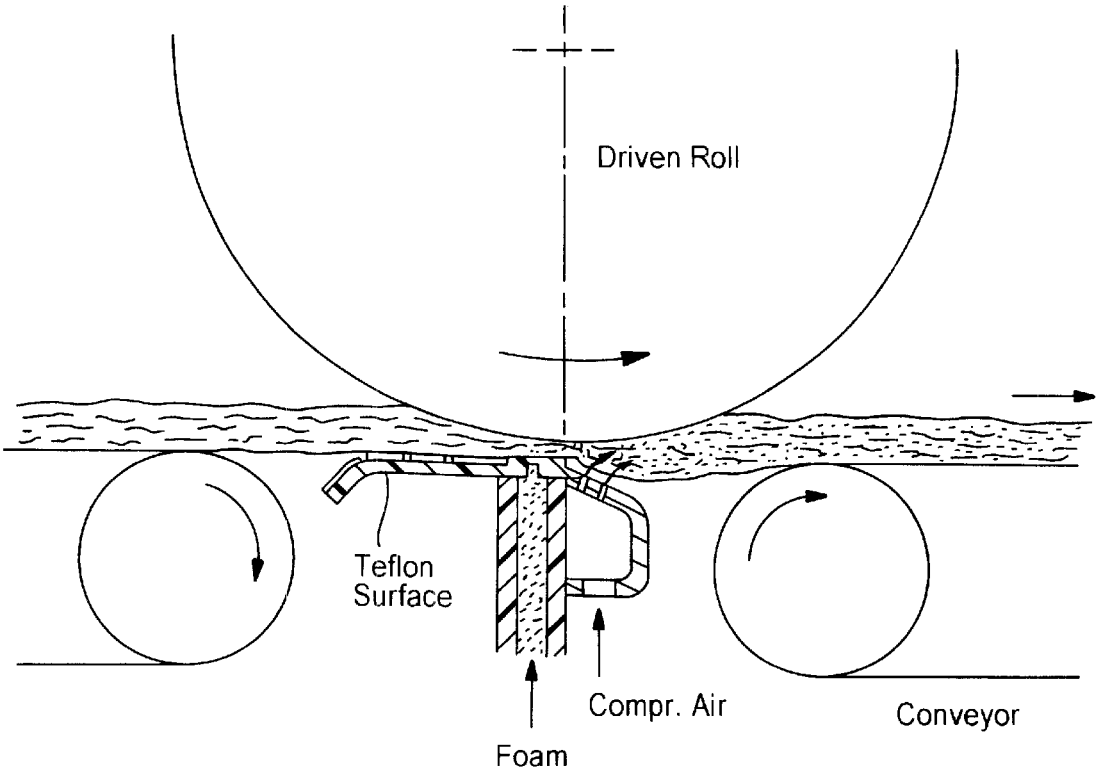
FIG. 1 is a schematic side elevation view of one form of apparatus suitable for carrying out the novel process of the present invention.

The fibers were carded using a roller top card, and the fibers were then cross-lapped on a custom made Sigma Corporation jigger lattice cross-lapper to achieve a final web basis weight of 50 g/m$^2$. Applicants, however, contemplate that the final web weight could range from about 25 to 400 g/m$^2$. Webs of each fiber type were then hydroentangled on a Honeycomb Systems laboratory unit in a second step at three energy levels (1800, 3600 and 7100 kJ/kg) and dried. Next, applicants used a Gaston County Foaming System laboratory unit in conjunction with a horizontal applicator and roll mechanism to apply the foam latex binder. Foam F was generated and applied through a horizontally extending pressure applicator A. A driven presser roll R was used to force the foam to penetrate through the entire web substrate S as shown in FIG. 1.

The foam binder mix consisted of water, the acrylic latex binder, and the foaming agent. The mix ratio was varied between 1.15% and 5% by weight to control the amount of binder on the fabric. There are two critical requirements for a foam with adequate stability to achieve both uniform surface coating and adequate fabric penetration: (1) a foam half-life in air of 4 to 5 minutes achieved by controlling foaming agent concentration at 0.5% bwt; and (2) a 10:1 blow ratio of air to liquid in the generator.

Table II set forth hereinbelow summarizes the experimental design. Because applicants contemplate mechanism changes from fiber to fiber, a full statistical matrix was not used. To provide statistical significance, and to measure the degree of repeatability, a replicate set of samples were made at the 1.25%, 2.5% and 5.0% binder add-on levels. A total of 36 replicate samples were made as shown in Table II below.

TABLE II

Experimental Design

| Fiber | Specific Energy (kJ/kg) | % Add-on | Binder Type |
|---|---|---|---|
| Acrylic, Cotton, Polyester | 1800 | 0, 1.25, 2.5, 5.0 | RHOPLEX ® NW-1715 |
| Acrylic, Cotton, Polyester | 3600 | 0, 1.25, 2.5, 5.0 | RHOPLEX ® NW-1715 |
| Acrylic, Cotton, Polyester | 3600 | 0, 1.25, 2.5, 5.0 | RHOPLEX ® NW-1845 |
| Acrylic, Cotton, Polyester | 7100 | 0, 1.25, 2.5, 5.0 | RHOPLEX ® NW-1715 |

Fabric breaking load, % elongation at maximum load, and the load at 5% strain were measured on an INSTRON Model No. 4400R using the ASTM D-1682 strip tensile test method. Each sample tested was of size 2.54 cm×20.32 cm, the speed of testing was 30.48 cm/min, and gage length was fixed at 7.62 cm. Bending rigidity was measured by the cantilever principle using the ASTM D-1388-64 cantilever bending test. The samples used were 2.54 cm×20.32 cm in size. Abrasion resistance was measured on a TABER abrasion tester Model No. 5150 using ASTM D-3884-92 standard abrasion test method. Four fabric samples each 12.7 cm×12.7 cm in dimension were tested. Two grade CS-10 abraders attached to 500 gm weight were used to abrade the samples. The vacuum level was kept constant at 100 mm of Hg for all fabric samples. The abrasion resistance was measured as the number of cycles of abrasion the spunlace fabric withstood until its surface was completely abraded.

Wet and dry recovery tests were performed on the INSTRON Model No. 4400R tester. Sample size was 2.54 cm×20.32 cm, the gage length was fixed at 7.62 cm, and the strain rate was 400% per minute. Five samples of each fabric in the machine direction were stretched to 5% strain and were then relaxed at a rate of 400% per minute. Load vs. strain (%) curves were then plotted for each fabric and the recovery (%) was then calculated from the graph for each specimen using the formula:

$$R=(R_s/I_s)\times 100$$

where:

R=% Recovery $R_s$=Recovered strain, %

$I_s$=Initial applied strain, %

The ratio of machine direction (MD) and cross direction (CD) values for dependent variables which are direction sensitive (for example, break strength and elongation) was nearly constant, and their response to the independent variables was consistent, so MD and CD values for these variables were averaged to simplify the analysis. Results from the two replicate data sets were statistically indistinguishable at the 5% level in the t-test so replicate and initial sets were further averaged to better display property trends.

Experimental Test Results

Figure 2:
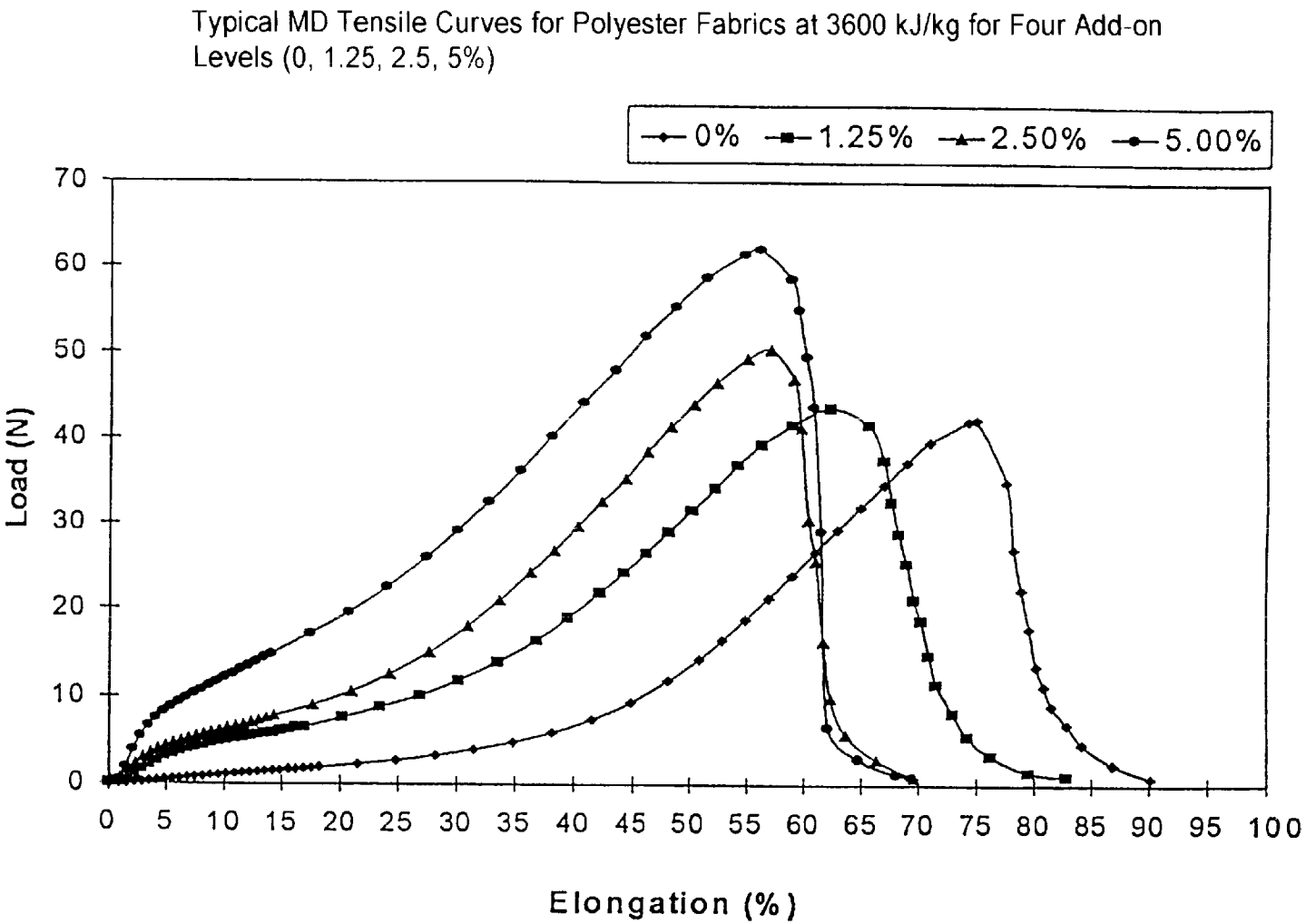
FIG. 2 is a graph showing strength characteristics of all polyester hydroentangled nonwoven fabric at 4 add-on levels.
Figure 3:
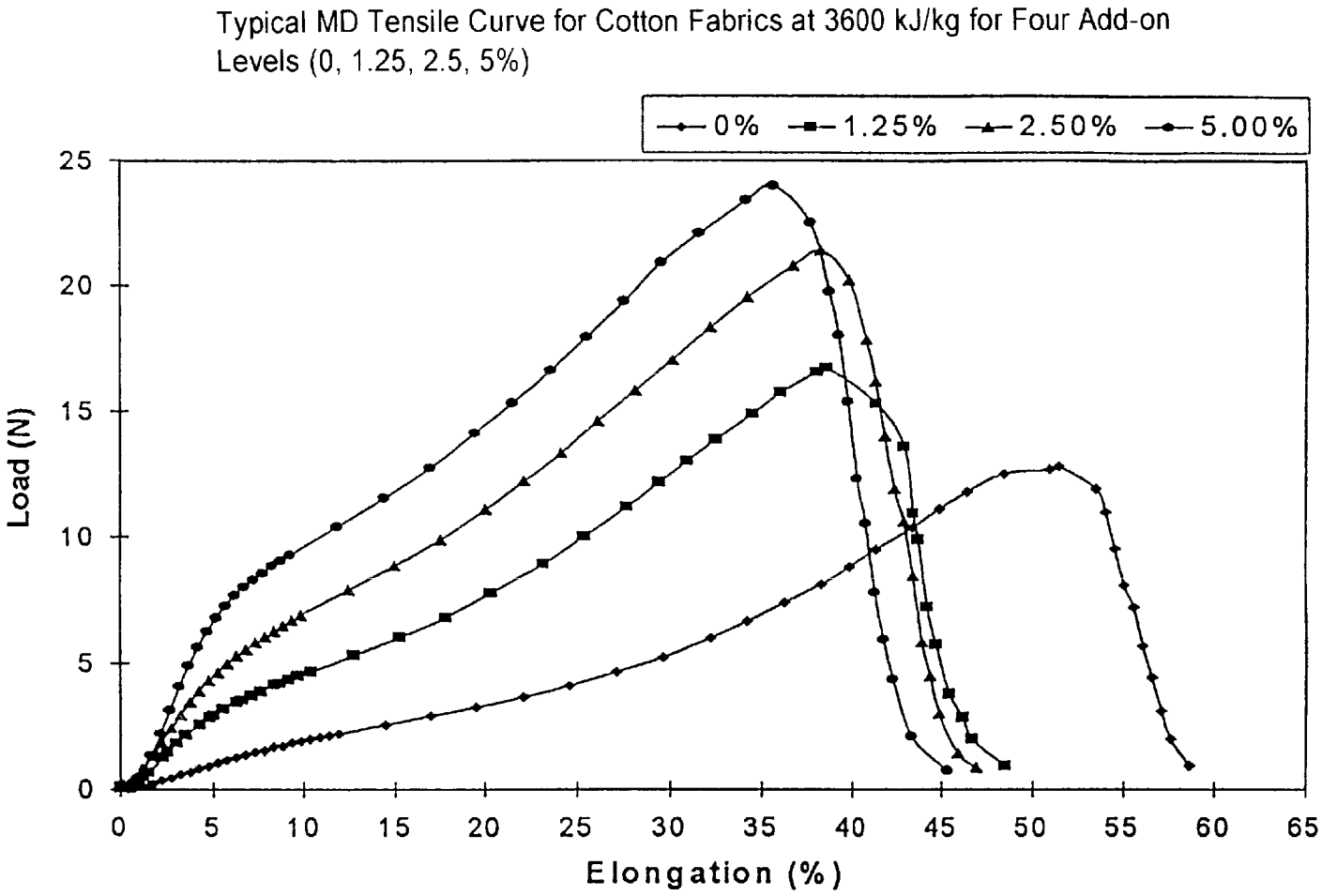
FIG. 3 is a graph showing strength characteristics of all cotton hydroentangled nonwoven fabric at 4 add-on levels.
Figure 4:
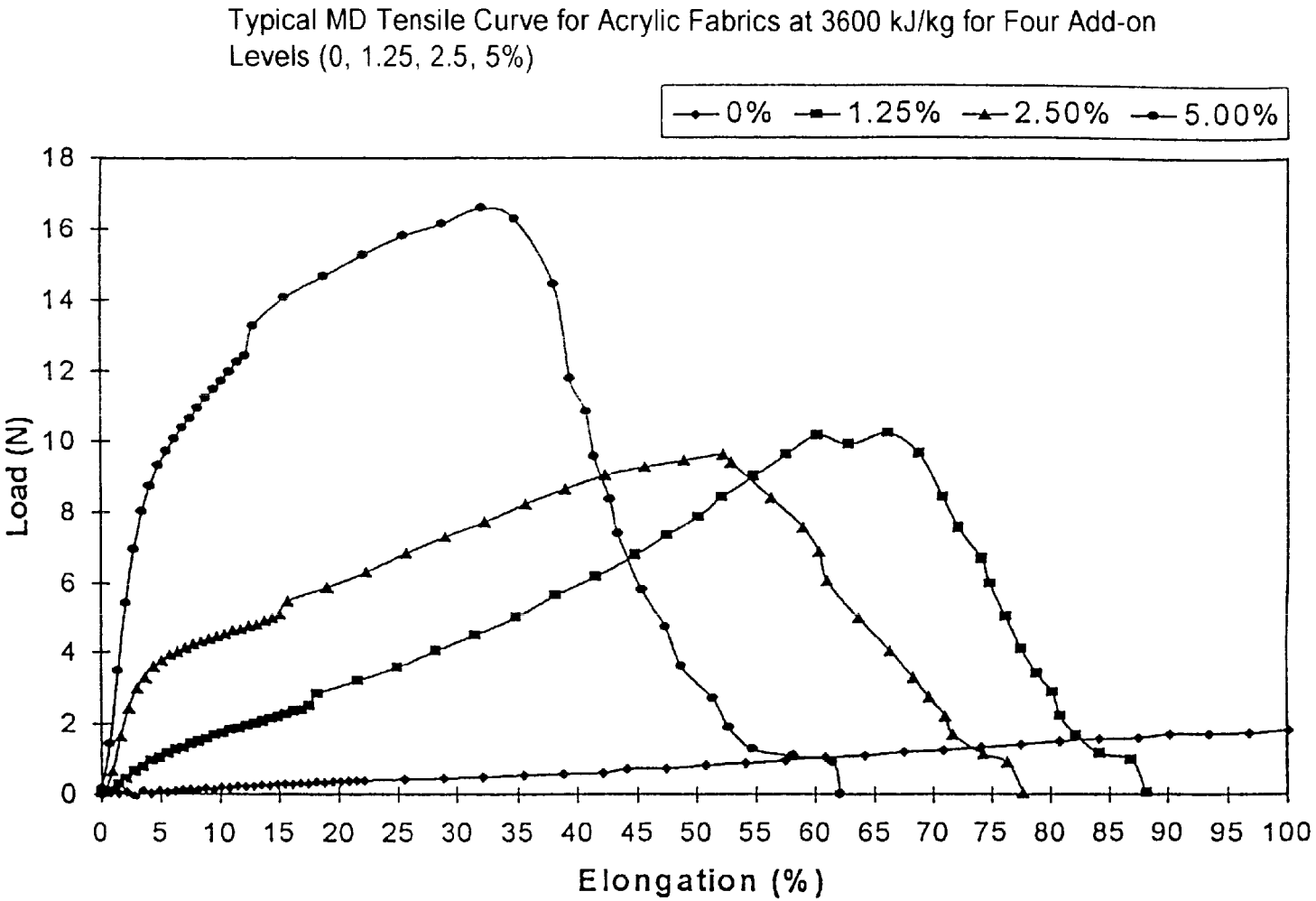
FIG. 4 is a graph showing strength characteristics of all acrylic hydroentangled nonwoven fabric at 4 add-on levels.

FIGS. 2 to 4 present the effect of foam binder addition on fabric MD stress/strain curves for the intermediate level of hydroentanglement energy (3600 kJ/kg) for all three fibers (polyester, cotton, acrylic). The effects illustrated were typical of all fabrics tested and exhibit the following characteristics:

(1) increasing break strength with increasing foamed binder level;

(2) decreasing break elongation with increasing foamed binder level; and (3) a more erect strain curve with higher initial modulus at higher foamed binder levels.

These characteristics are all consistent with improved hydroentangled fiber bonding.

Figure 5:
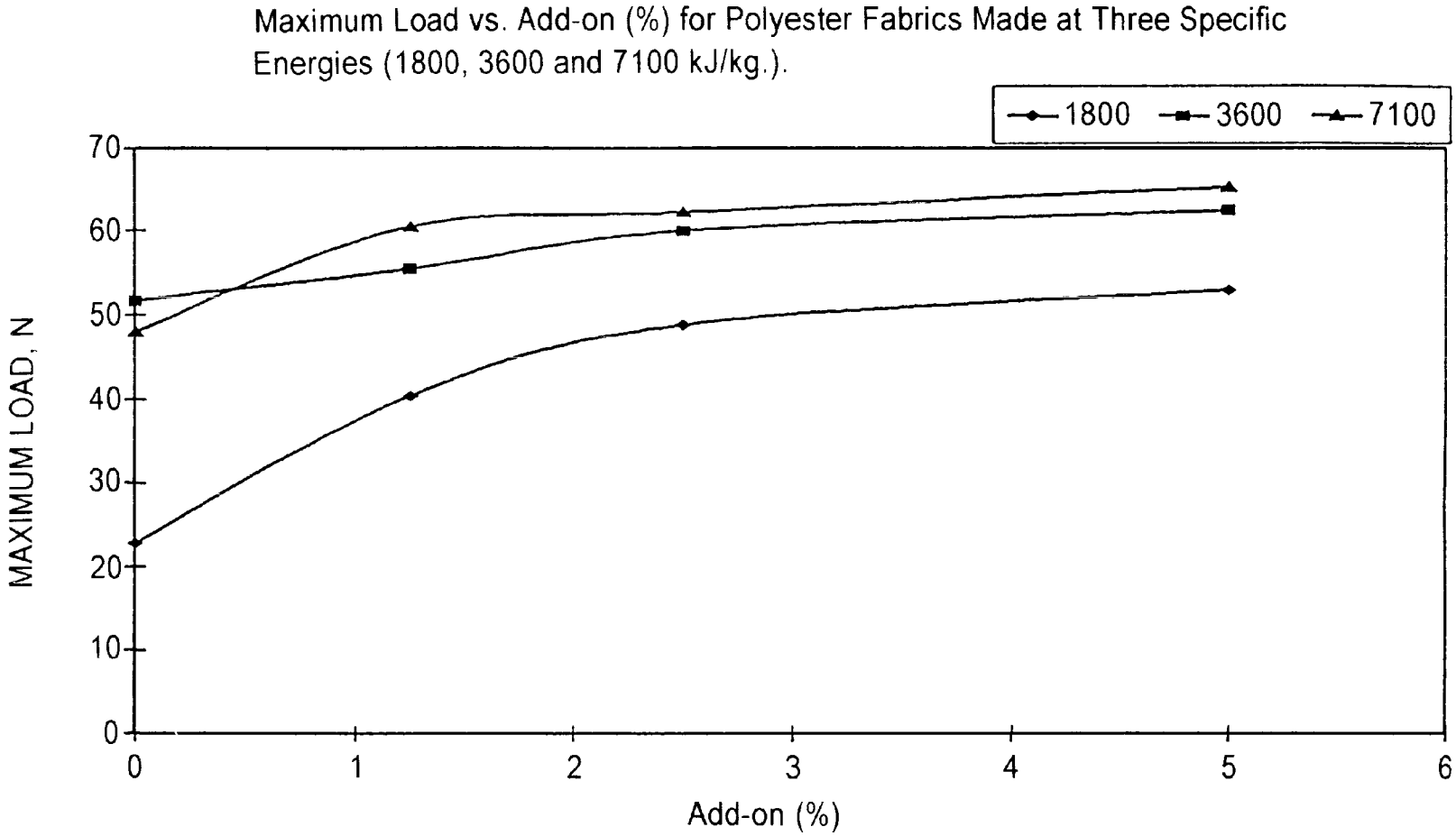
FIG. 5 is a graph showing maximum break load versus the amount of foamed binder add-on for all polyester hydroentangled nonwoven fabric made at 3 energy levels.
Figure 6:
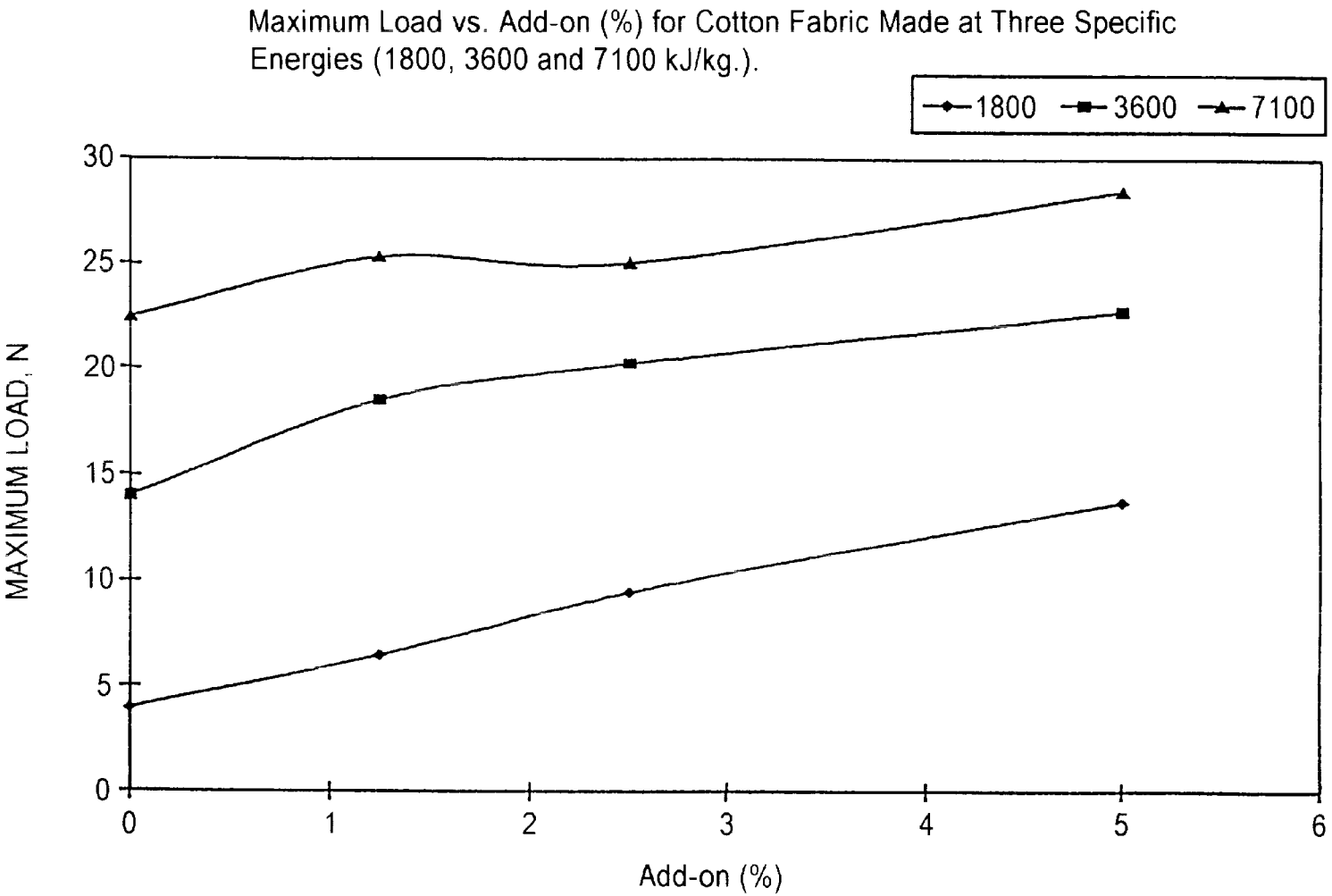
FIG. 6 is a graph showing maximum break load versus the amount of foamed binder add-on for all cotton hydroentangled nonwoven fabric made at 3 energy levels.
Figure 7:
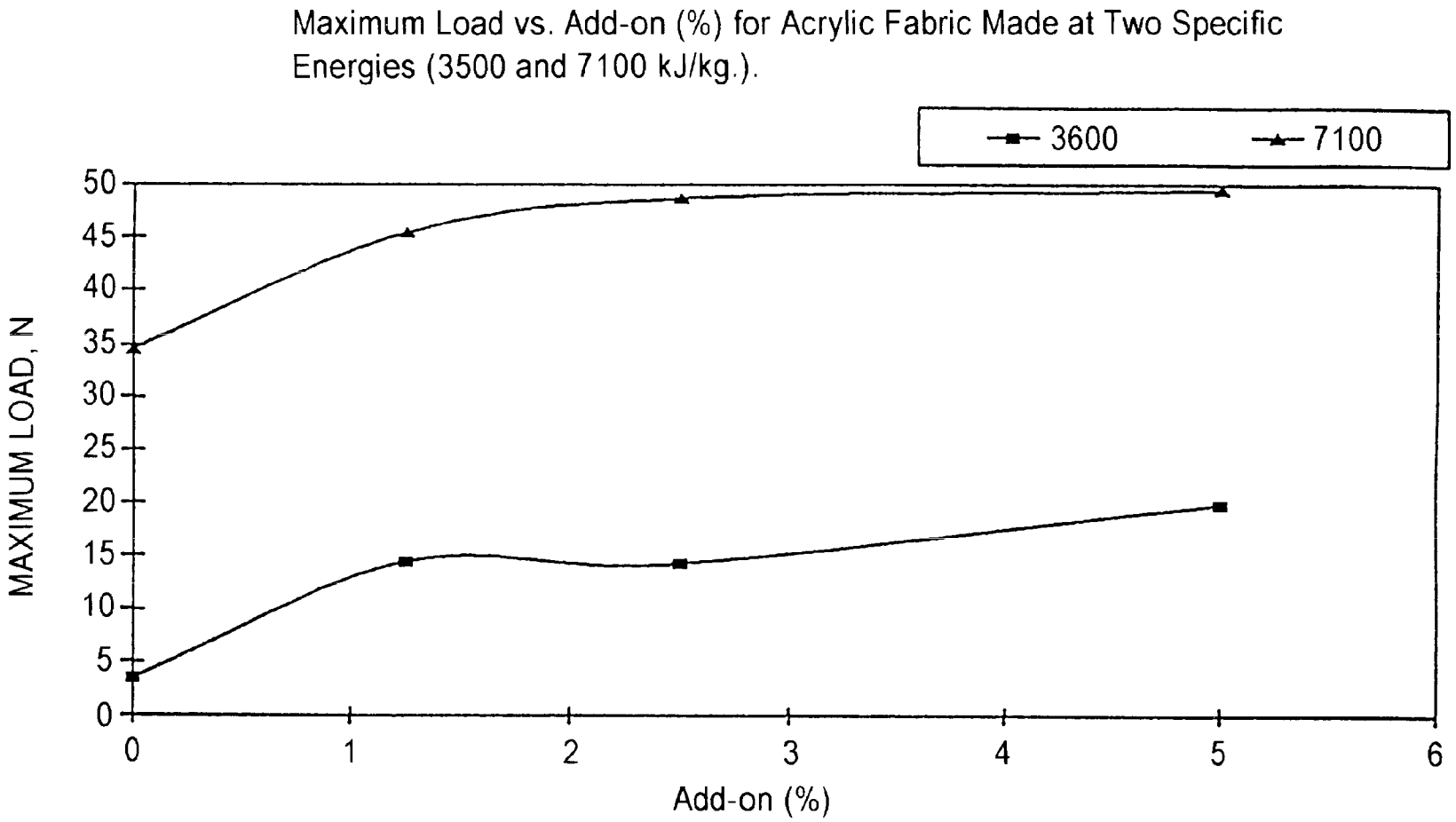
FIG. 7 is a graph showing maximum break load versus the amount of foamed binder add-on for all acrylic hydroentangled nonwoven fabric made at 3 energy levels.

Fibers differ in their ability to convert water jet energy during hydroentanglement into entangled fiber bonds and thus binder-free maximum break load differs greatly. For example, when 3600 kJ/kg of water jet energy is applied to polyester, cotton and acrylic fibers, break loads for the fabrics were 48, 14 and 4 N/2.54 cm width, respectively. Webs of acrylic fiber hydroentangled at 1800 kJ/kg acted more like unbonded bats than fabric, and were excluded by applicants from further analysis. FIGS. 5, 6 and 7 illustrate the effect of adding foam binder to the system. In general, the poorer the binder-free hydroentanglement, the greater the relative improvement realized with foam bonding.

Figure 8:
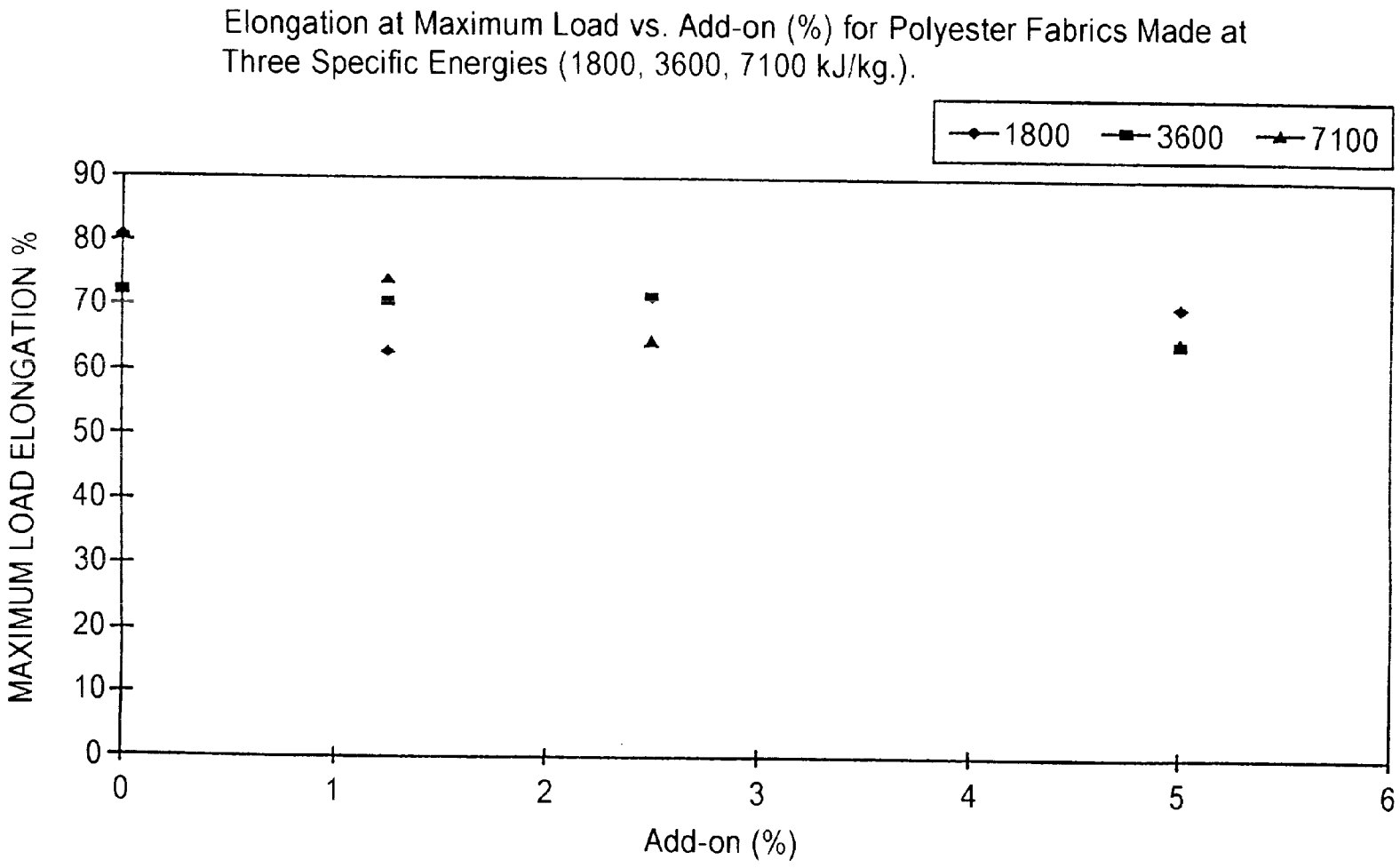
FIG. 8 is a graph showing elongation at maximum load for all polyester hydroentangled nonwoven fabric made at 3 energy levels.
Figure 9:
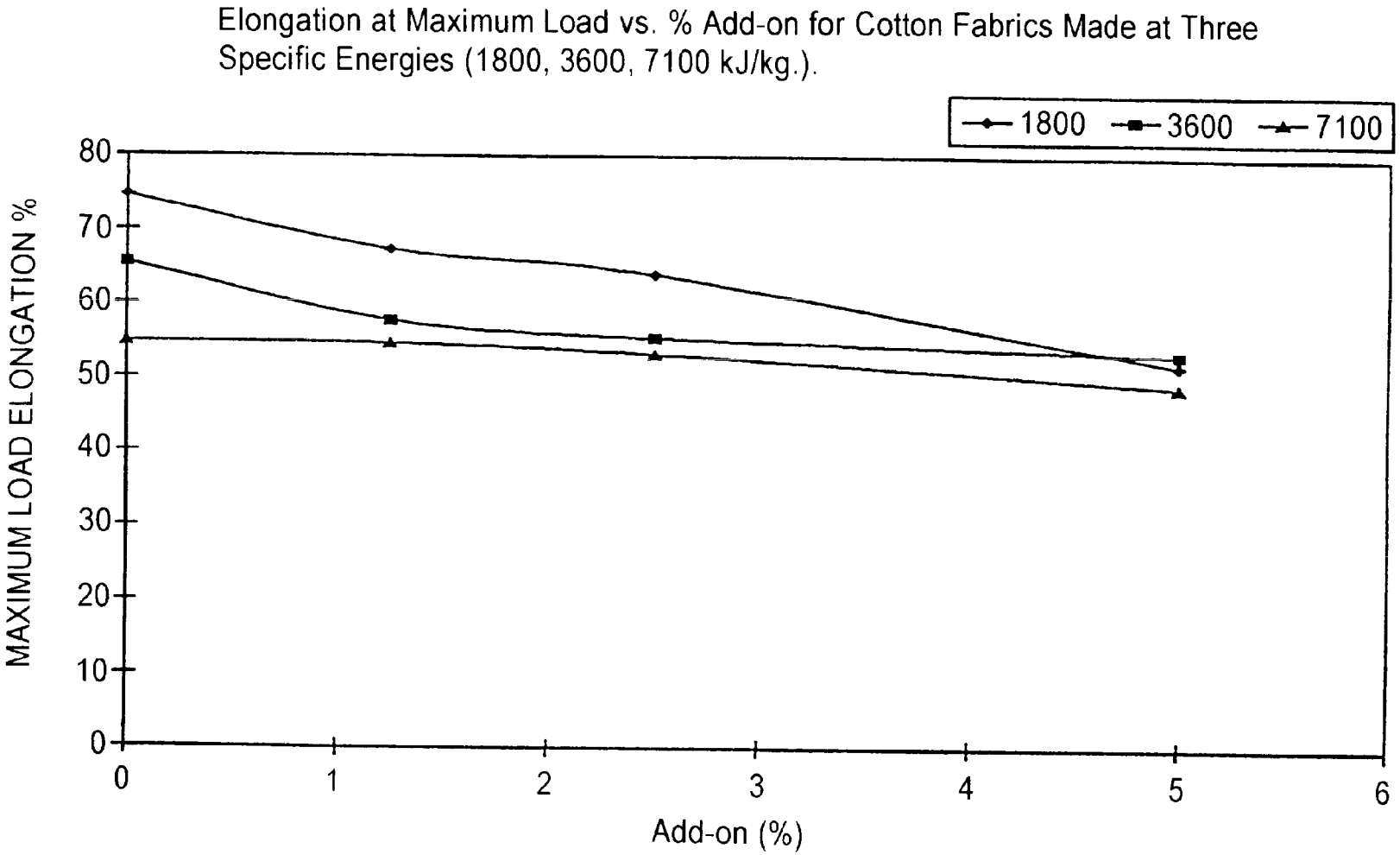
FIG. 9 is a graph showing elongation at maximum load for all cotton hydroentangled nonwoven fabric at 2 energy levels.
Figure 10:
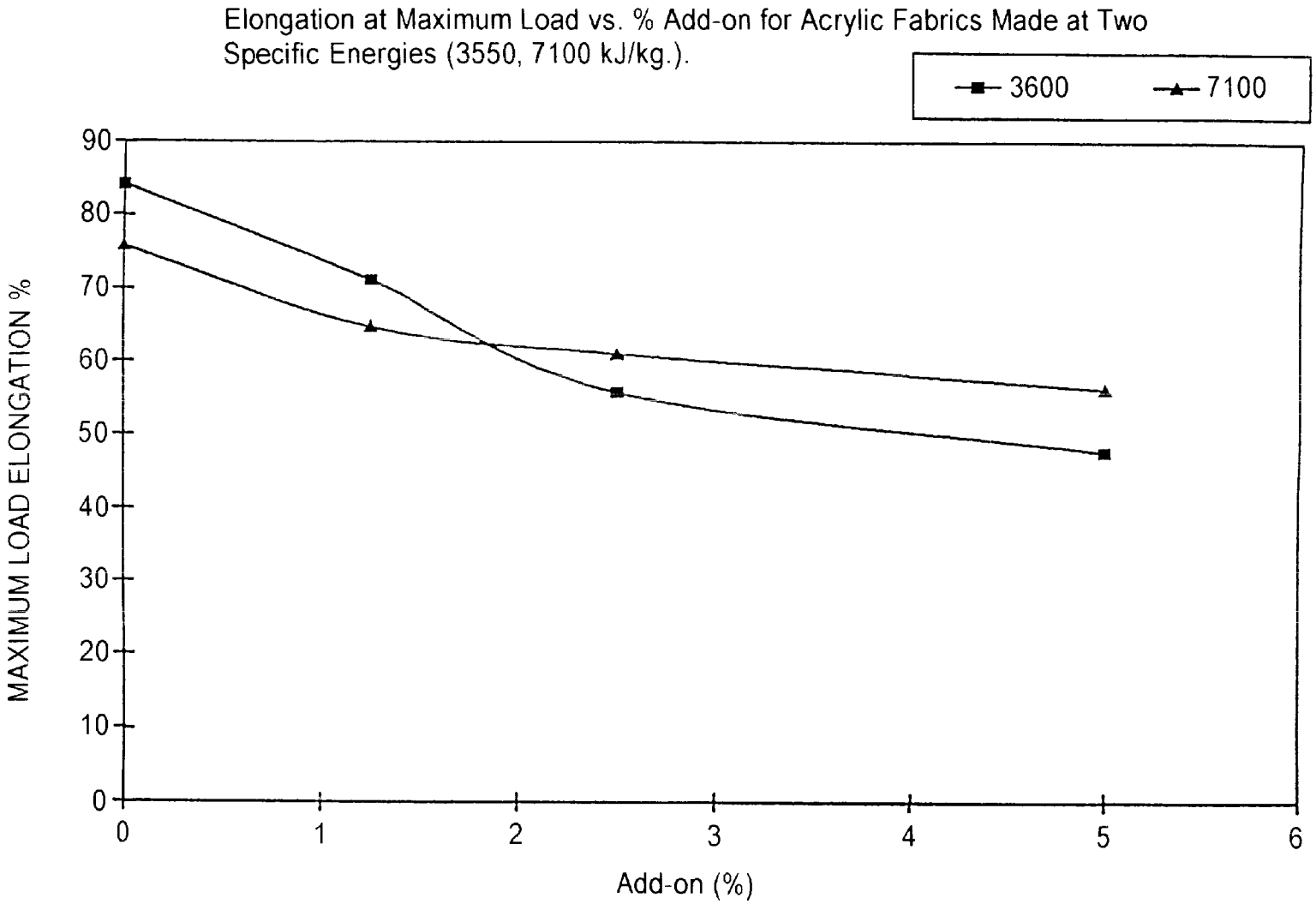
FIG. 10 is a graph showing elongation at maximum load for all acrylic hydroentangled nonwoven fabric at 2 energy levels.

Elongation at maximum load in nonwovens is, in general, inversely related to maximum load carrying capacity. As indicated in FIGS. 8, 9 and 10 the change in elongation when low levels of foamed binder are added is greatest for those fibers which are poorly bonded by hydroentangling.

The stress/strain curves of nonwovens are highly nonlinear (FIGS. 2, 3 and 4) and thus the modulus is difficult to define. In applicants' testing, nearly all of the fabrics had linear curves up to 5% strain so that comparison of load at this strain level should provide insight into fabric response to strains encountered in converting the nonwoven fabric to the final commercial product.

Figure 11:
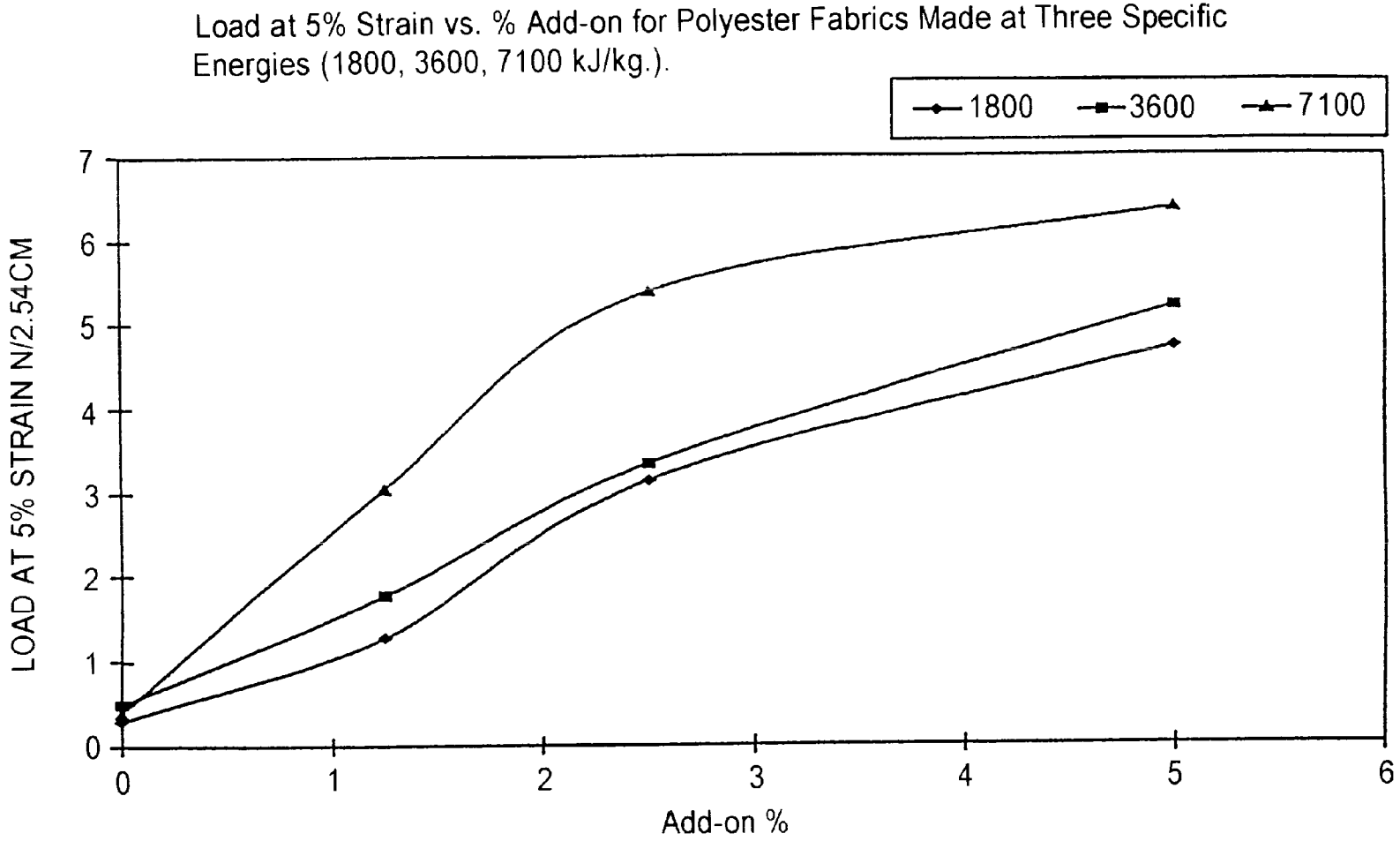
FIG. 11 is a graph showing the load at 5% strain versus % add-on at 3 specific energy levels of hydroentanglement for all polyester hydroentangled (spunlace) nonwoven fabric.
Figure 12:
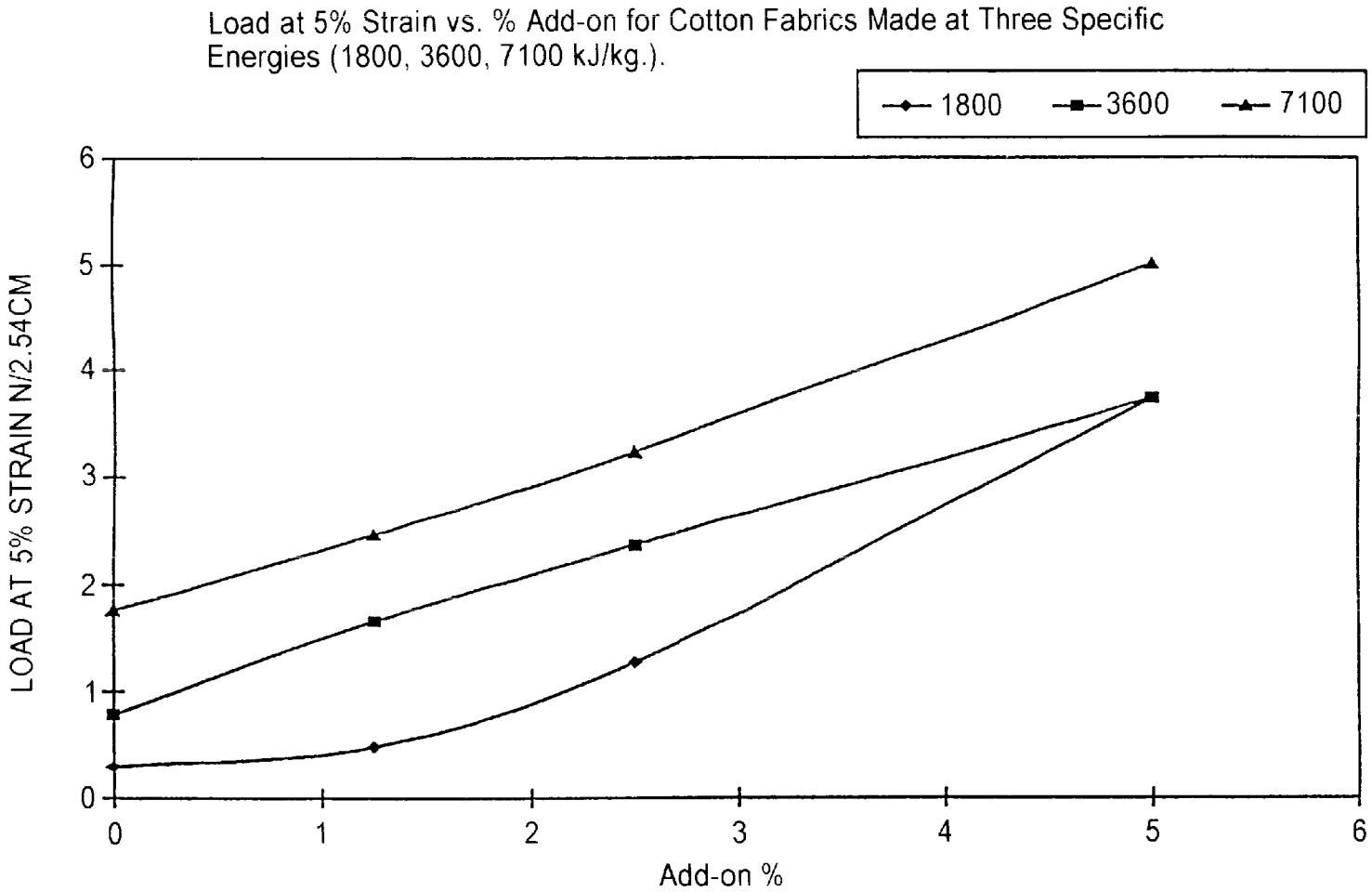
FIG. 12 is a graph showing the load at 5% strain versus % add-on at 3 specific energy levels of hydroentanglement for all cotton hydroentangled (spunlace) nonwoven fabric.
Figure 13:
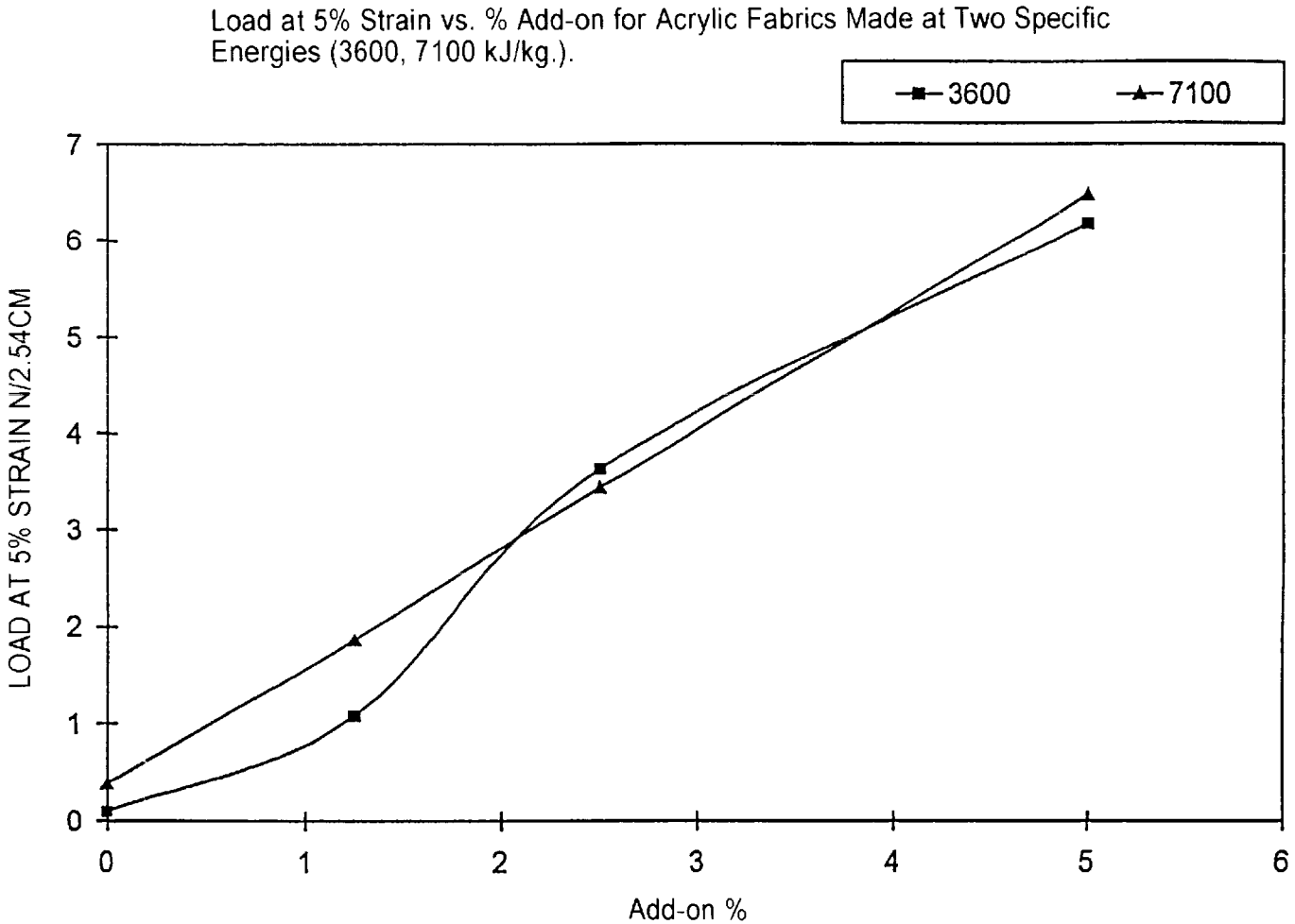
FIG. 13 is a graph showing the load at 5% strain versus % add-on at 3 specific energy levels of hydroentanglement for all acrylic hydroentangled (spunlace) nonwoven fabric.

As indicated in FIGS. 11, 12 and 13, the addition of extremely small levels of foamed binder dramatically increases fabric initial modulus no matter how efficiently the fabric is hydroentangled in terms of break strength and elongation. This improvement which ranges between 200 to 600% has potential for improving fabric processability during the converting process.

Figure 14:
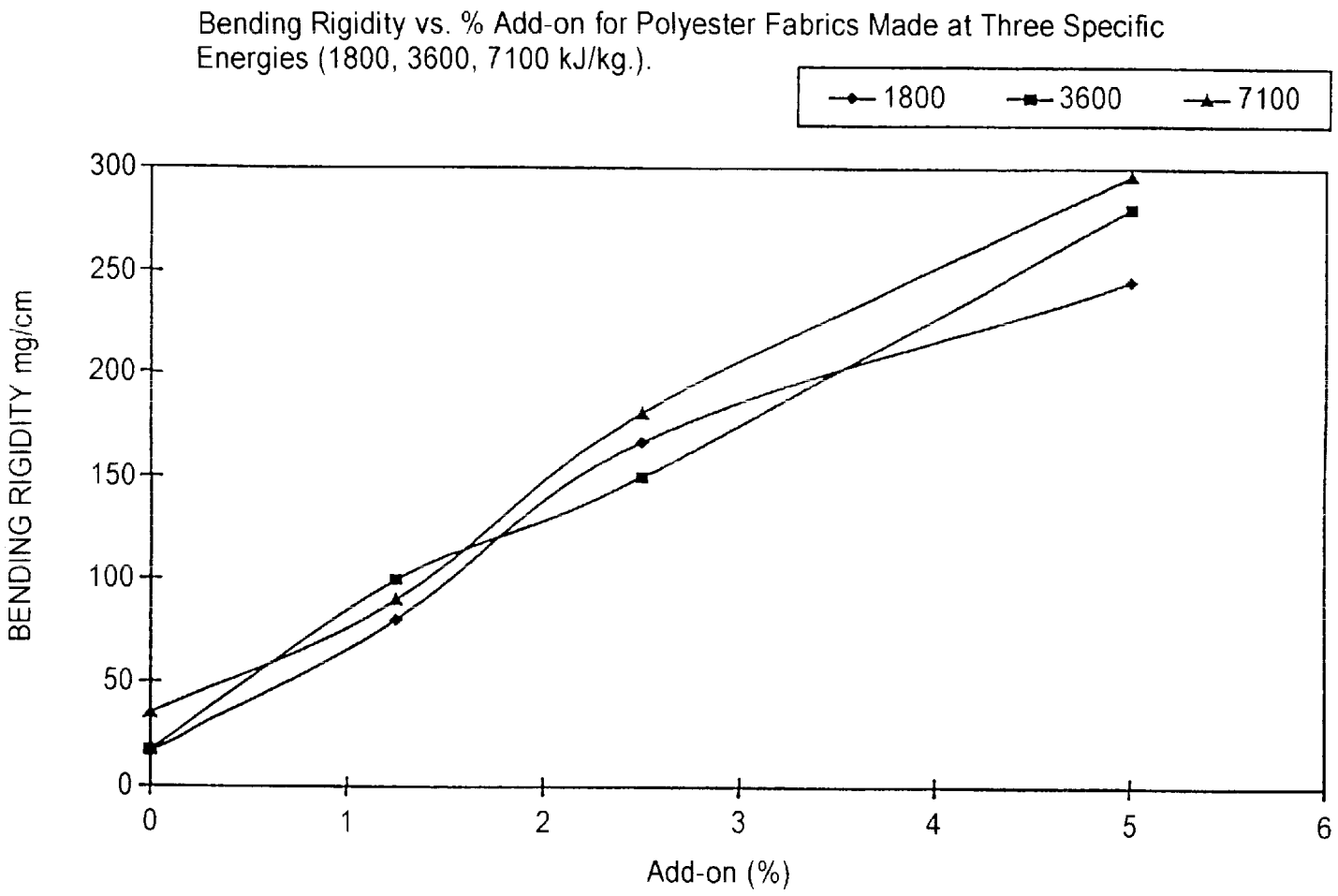
FIG. 14 is a graph showing fabric bending versus binder add-on for all polyester hydroentangled (spunlace) nonwoven fabric at 3 different hydroentanglement energy levels.
Figure 15:
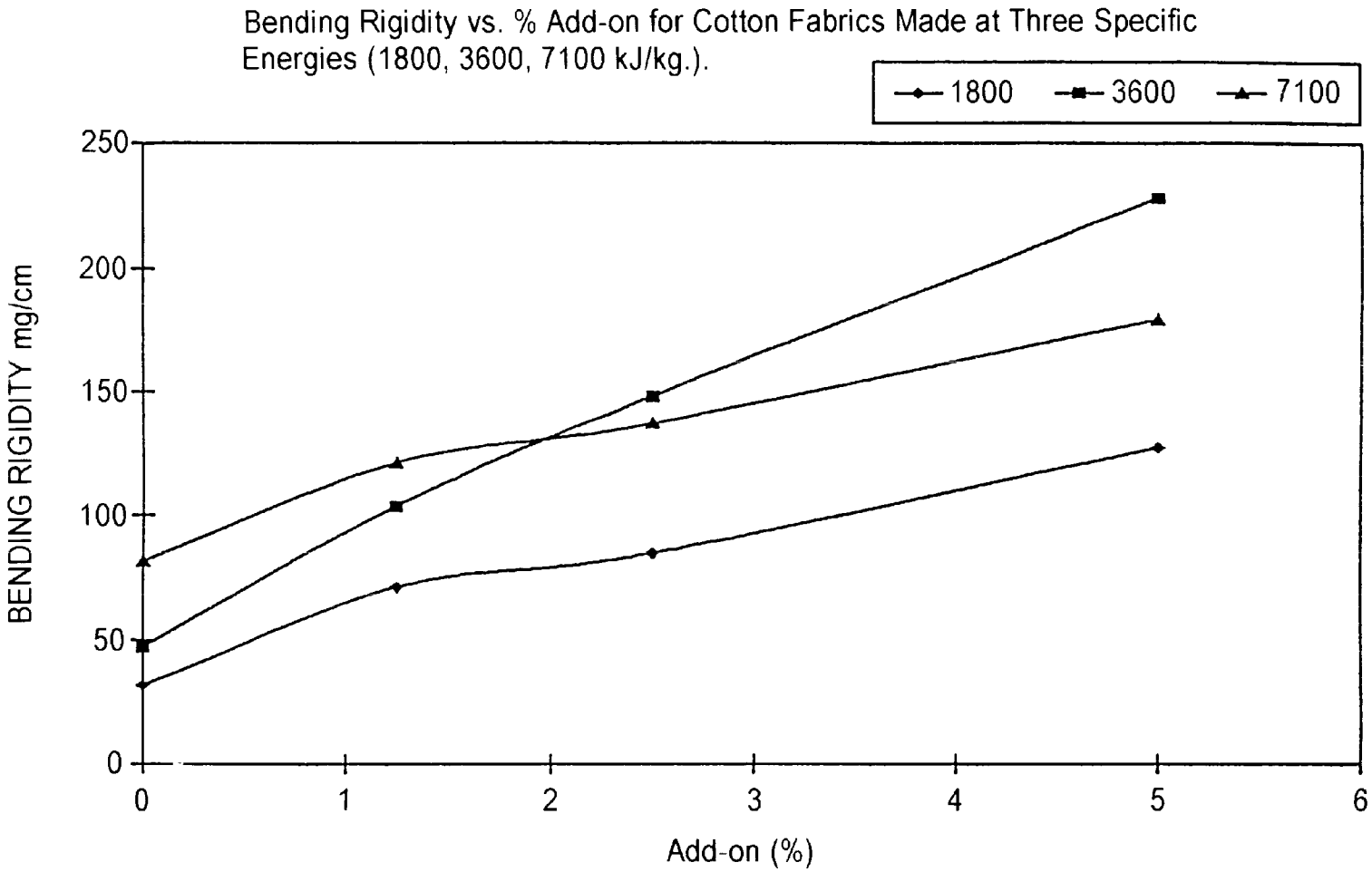
FIG. 15 is a graph showing fabric bending versus binder add-on for all cotton hydroentangled (spunlace) nonwoven fabric at 3 different hydroentanglement energy levels.
Figure 16:
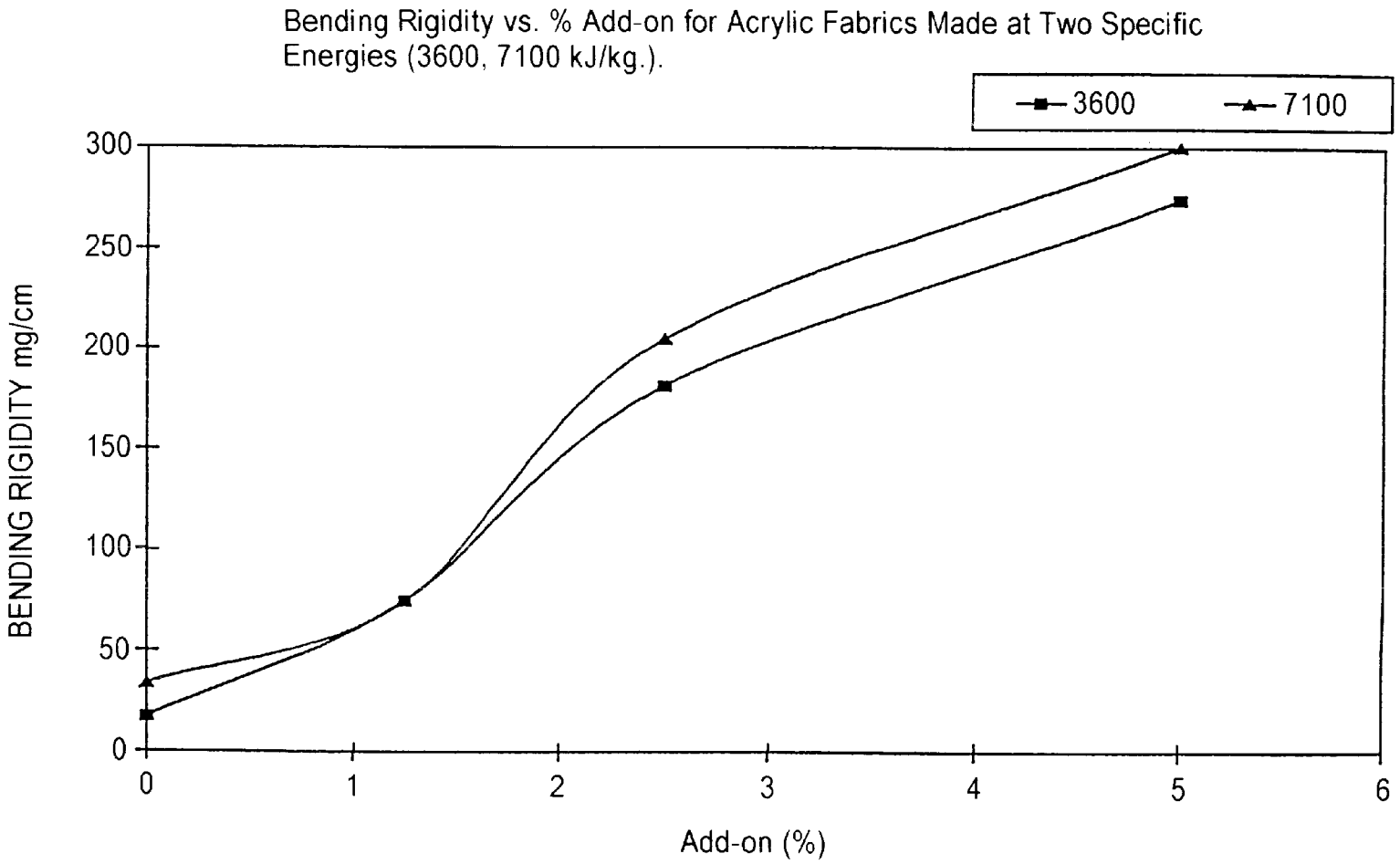
FIG. 16 is a graph showing fabric bending versus binder add-on for all acrylic hydroentangled (spunlace) nonwoven fabric at 3 different hydroentanglement energy levels.

Bending rigidity was used as a rough measure of nonwoven fabric hand. Applicants discovered that rigidity increased roughly proportionally with binder loading (see FIGS. 14, 15 and 16). Therefore, one would expect that fabric hand will of necessity need to be traded for the beneficial improvements in tensile properties and abrasion resistance.

Bending rigidity can also be estimated from tensile behavior using the classical equation:

$$M=EI$$

where M is the bending rigidity, E is the fabric Young's Modulus, and I is the fabric moment of inertia (in this case a constant).

Assuming that Young's Modulus is proportional to load at 5% strain ($L_{5\%}$), the following relationship is pertinent:

$$E=k_1(L_{5\%})$$

where $k_1$ is a constant.

So, bending rigidity becomes:

$$M=k_1(L_{5\%})$$

This assumption is confirmed when all data points for all three fibers at all binder levels are plotted in a conventional correlation test plot for bending rigidity and load at 5% strain. Applicants believe, therefore, that a simple determination of load at 5% strain can be used to characterize bending rigidity, possibly with greater accuracy than the error prone direct measurement itself.

Figure 17:
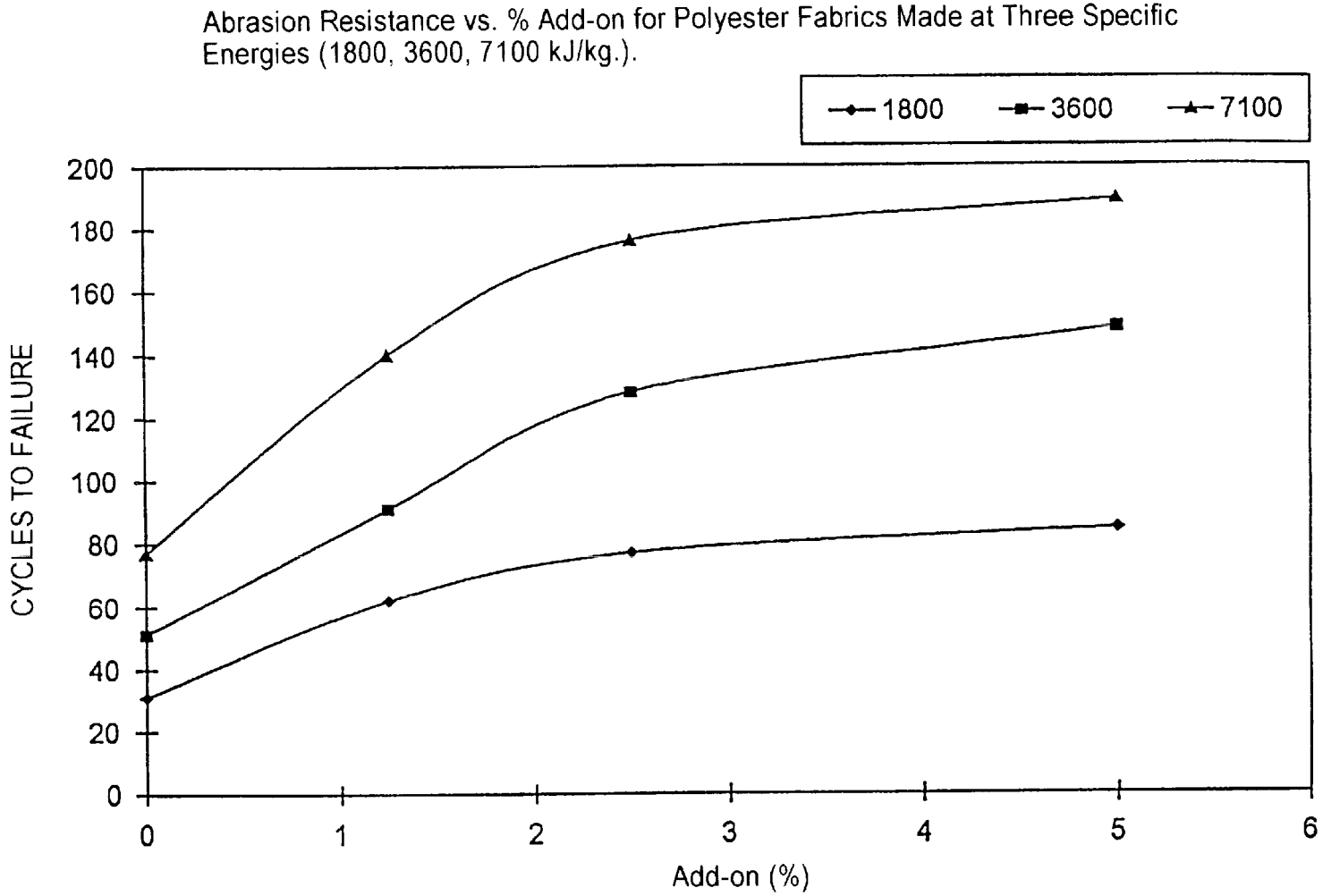
FIG. 17 is a graph showing fabric abrasion resistance as a function of foamed binder add-on at 3 different hydroentangling energy levels for all polyester hydroentangled (spunlace) nonwoven fabric.
Figure 18:
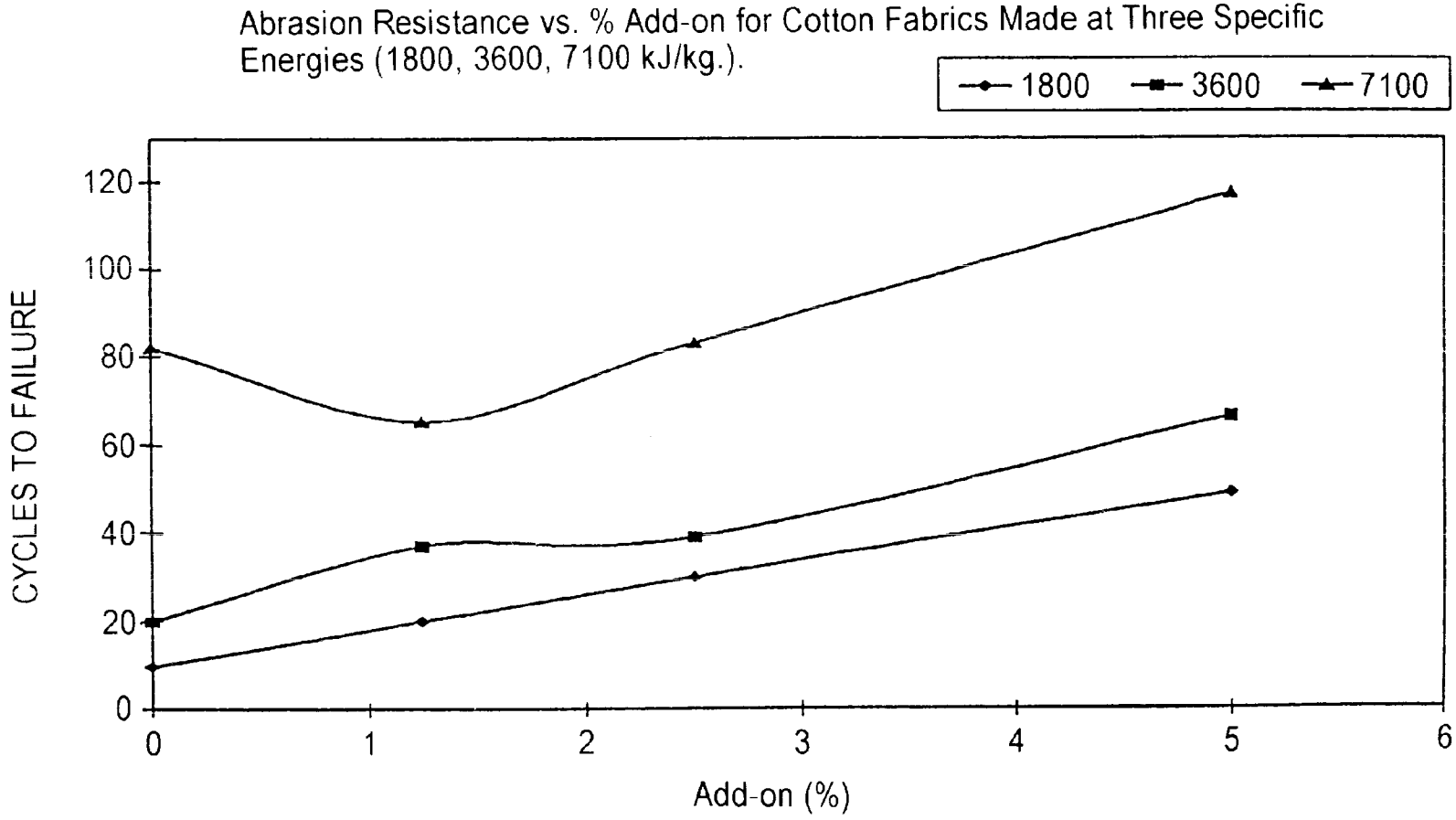
FIG. 18 is a graph showing fabric abrasion resistance as a function of foamed binder add-on at 3 different hydroentangling energy levels for all cotton hydroentangled (spunlace) nonwoven fabric.
Figure 19:
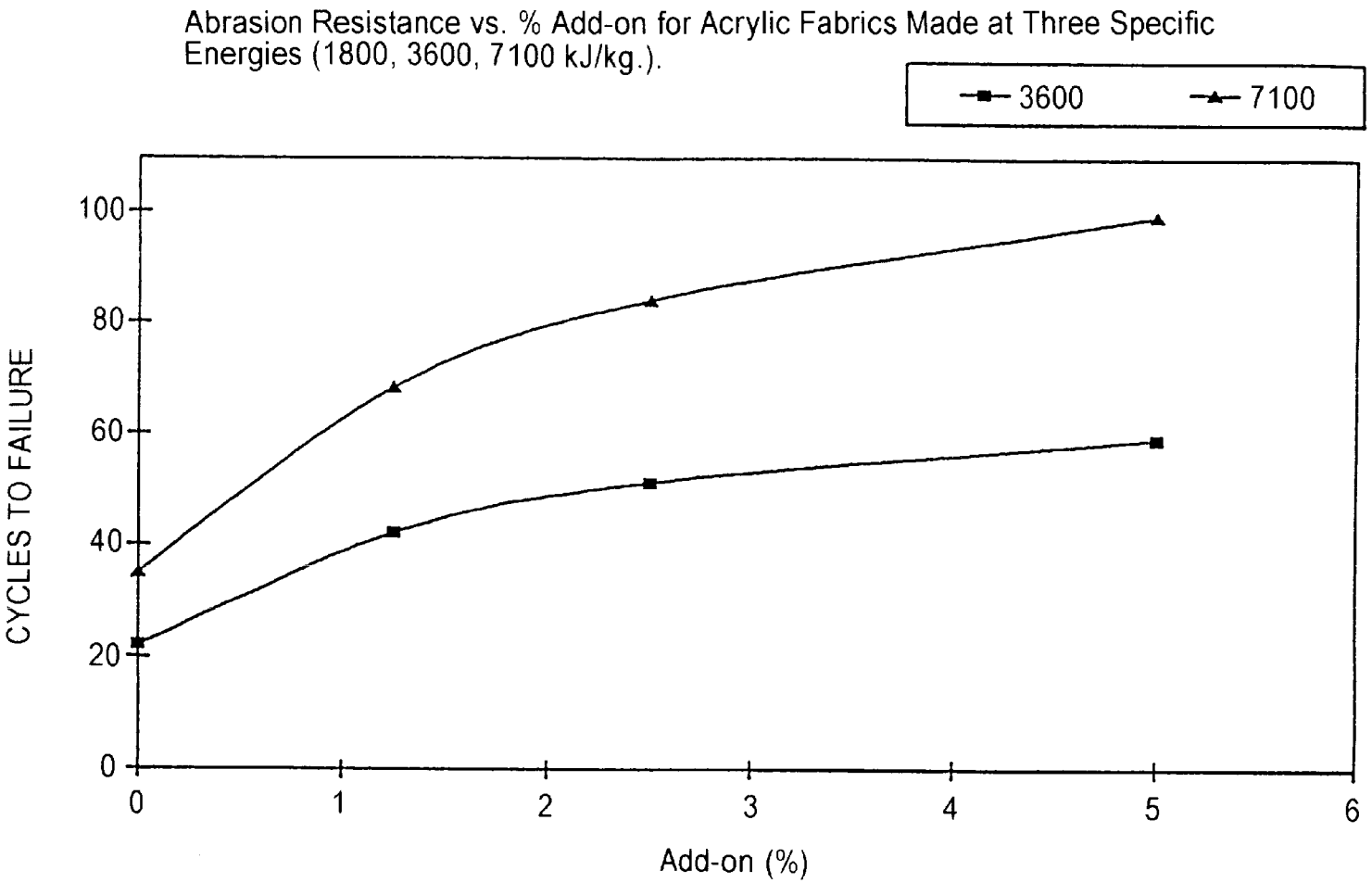
FIG. 19 is a graph showing fabric abrasion resistance as a function of foamed binder add-on at 3 different hydroentangling energy levels for all acrylic hydroentangled (spunlace) nonwoven fabric.

Fabric abrasion effects are dominated by the presence of poorly bonded surface fibers which become entrapped in the abrading material, increase the intensity of the abrading surface, and lead to early fabric failure. Addition of extremely small amounts of binder provide a 180% to 200% improvement in fabric performance for all three fiber systems at all energy levels (see FIGS. 17, 18 and 19). The mechanism appears to be one of reducing the number and length of poorly bonded surface fibers.

Figure 20:
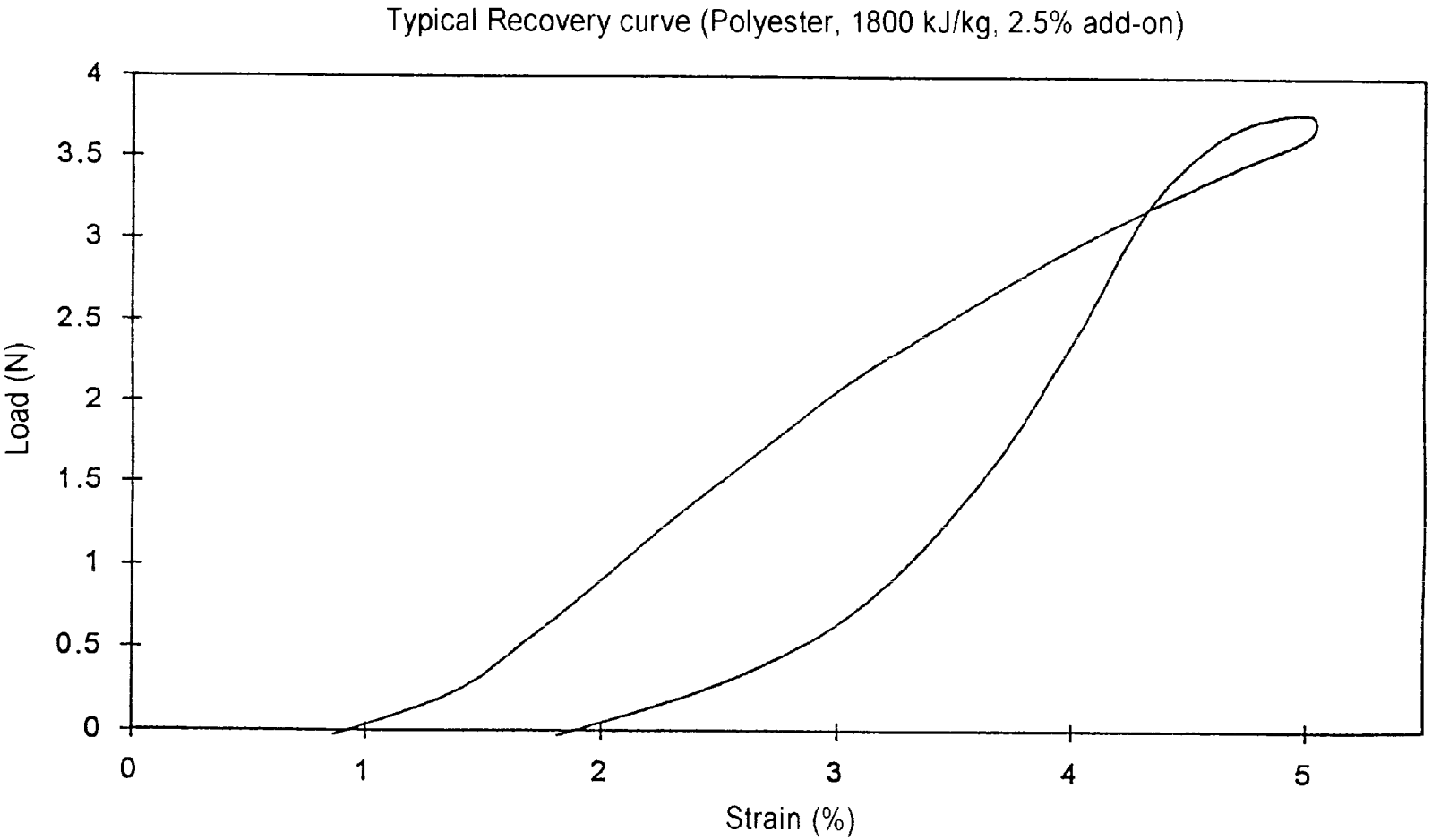

In the course of processing from roll goods to finished article, nonwoven fabrics are subjected to small strains in machines which are much stronger than the fabric. To preserve dimensional stability, it is desirable that all strain is recovered by the fabric. In fact, however, this is rarely the case. Applicants tested this phenomenon by straining the fabrics 5% and determining the amount of strain recovered as the load is reduced to zero. FIG. 20 is a typical stress/strain curve for such a trial.

Figure 21:
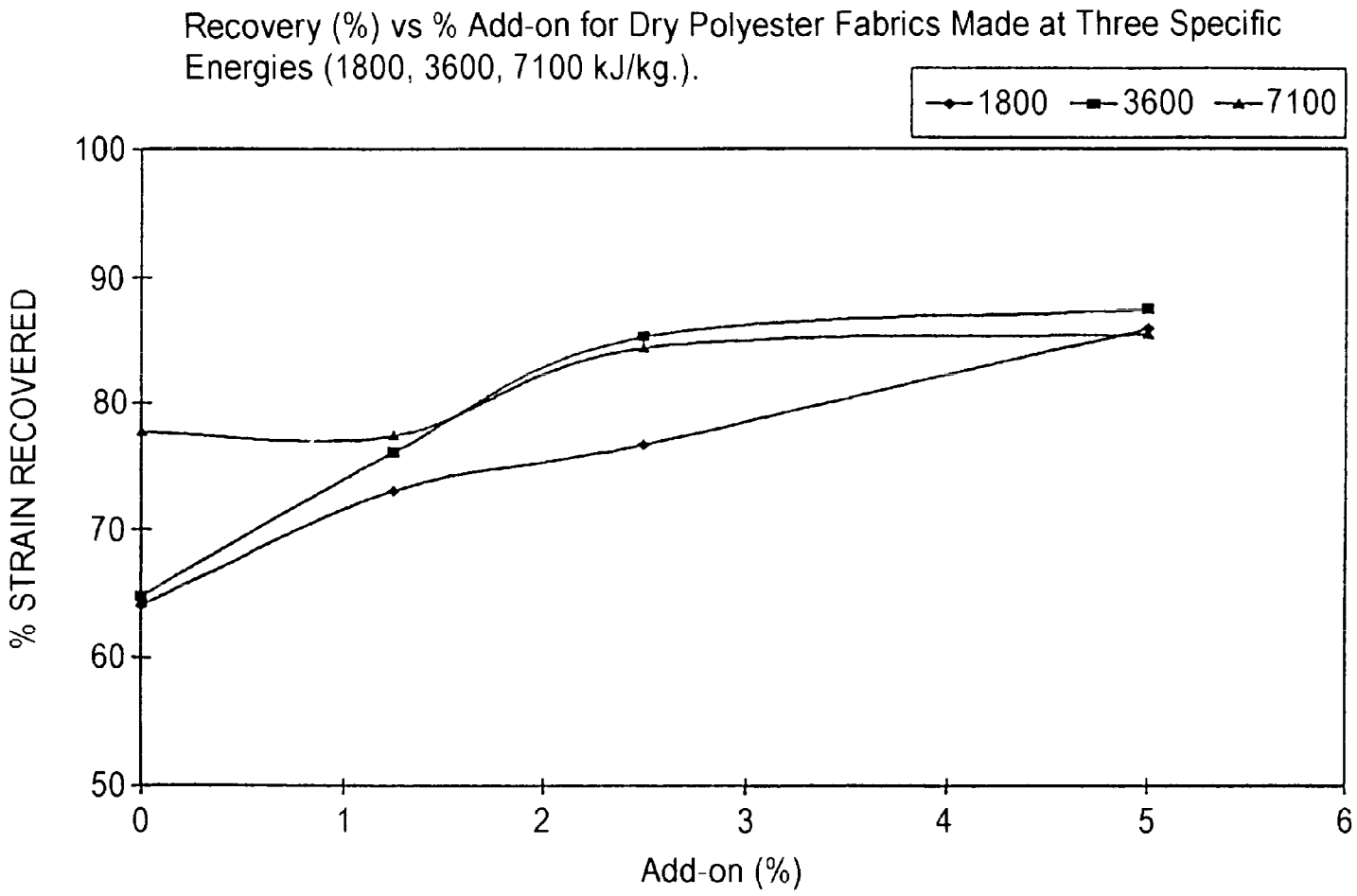
FIG. 21 is a graph showing recovery versus foamed binder add-on for dry polyester hydroentangled (spunlace) nonwoven fabric made at 3 different energy levels.
Figure 22:
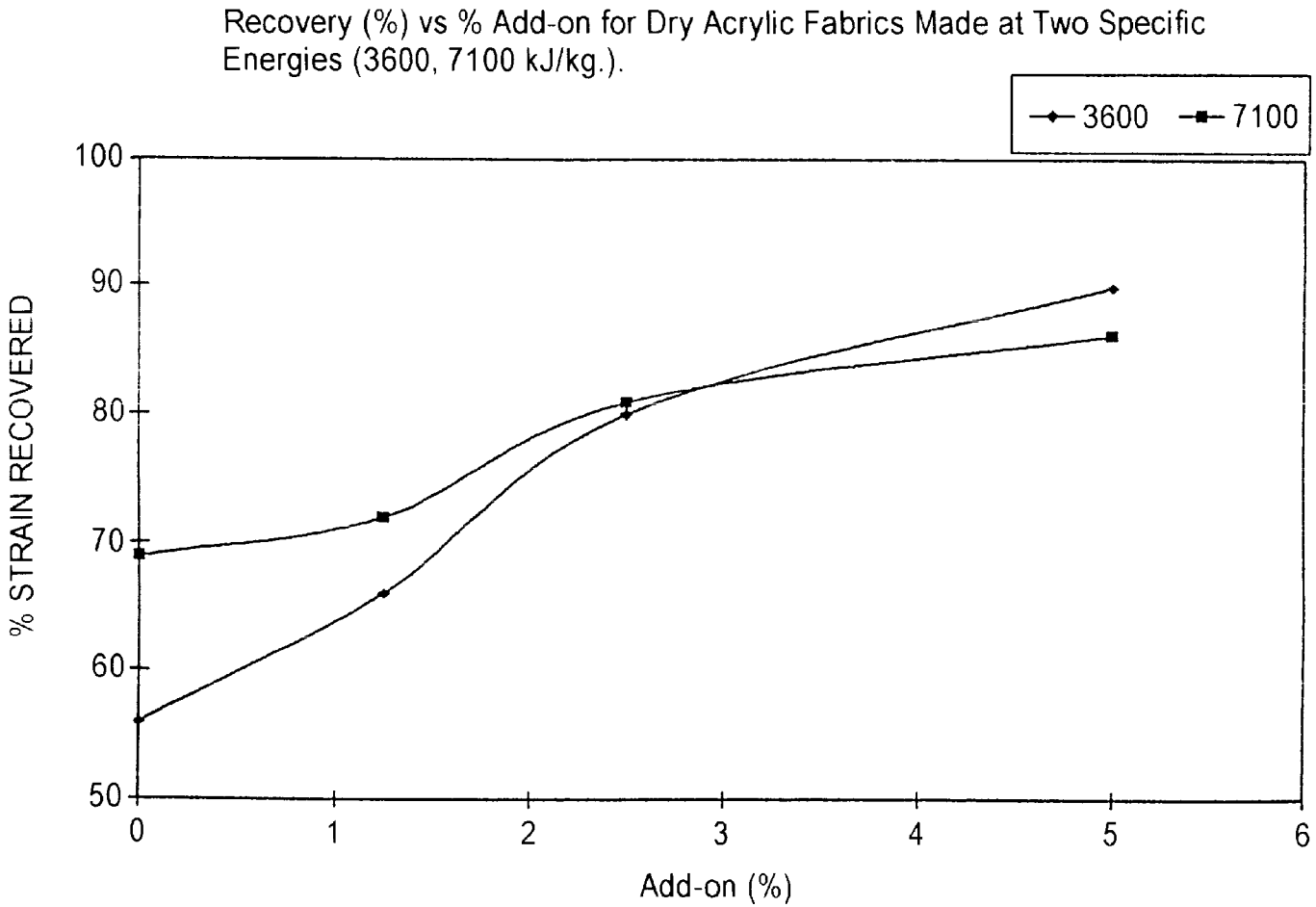
FIG. 22 is a graph showing recovery versus foamed binder add-on for dry acrylic hydroentangled (spunlace) nonwoven fabric made at 2 different energy levels.

Applicants' tests discovered that the addition of small amounts of binder to both polyester and acrylic fabrics significantly increased recovery (see FIGS. 21 and 22). In the case of polyester, 2.5% binder increased recovered strain from about 60% to 85%. For acrylic fabrics the improvement was from 55% to 80%. Dimensional stability of both fabrics would therefore improve.

The increase in load as strain is decreased from its maximum is a commonly observed effect having to do with a lag between the response time of the instrument force and strain measurements. This can be eliminated with slower strain rates or software modifications taking into account the force measurement response time.

Figure 23:
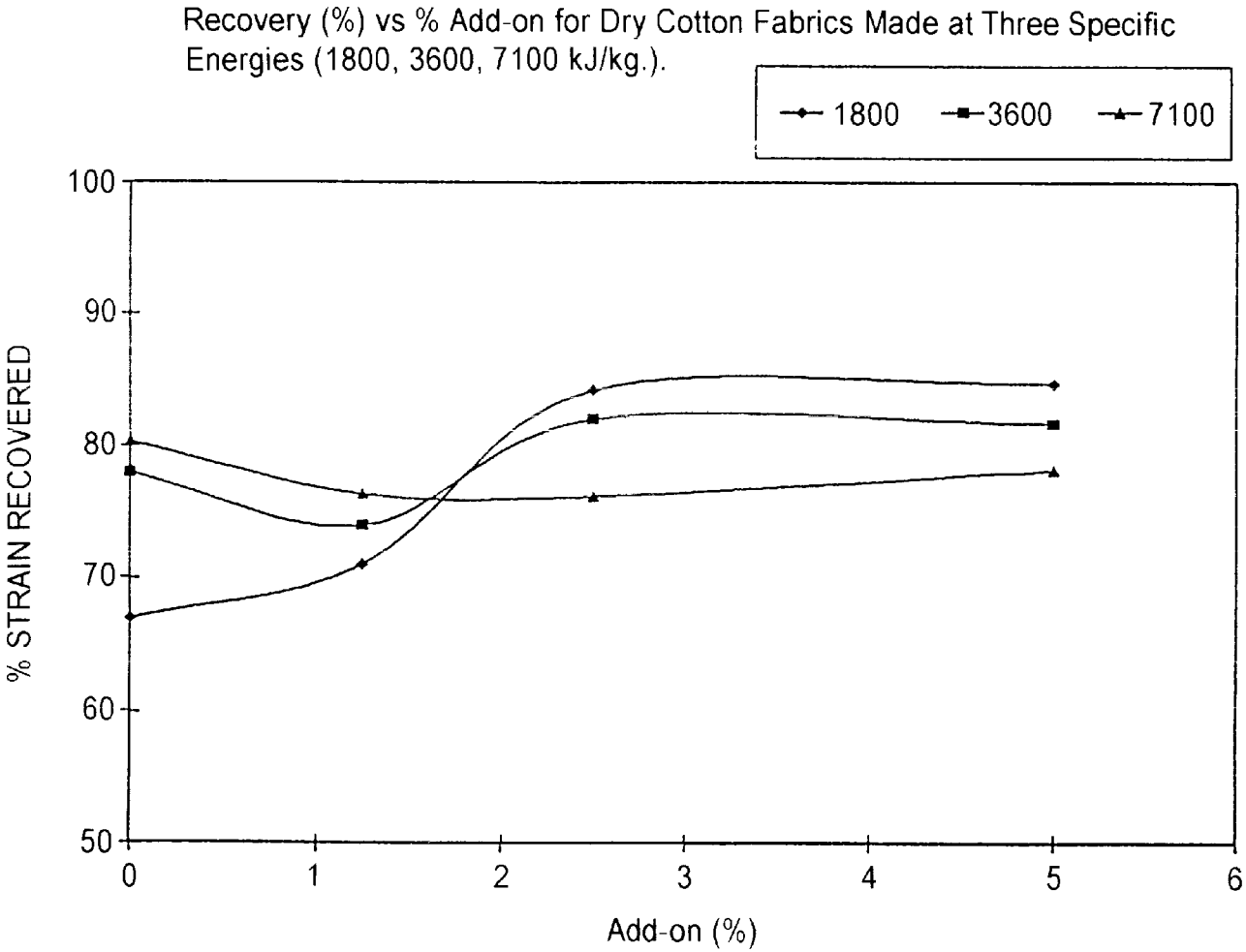
FIG. 23 is a graph showing recovery versus foamed binder add-on for dry cotton hydroentangled (spunlace) nonwoven fabric made at 3 different energy levels.

The behavior of cotton was different. As indicated in FIG. 23, strain recovery for binder-free cotton fabric was relatively good, particularly at the higher energy levels. Addition of foamed binder did not provide the dramatic improvement encountered with the synthetic fibers.

Applicants believe that this may relate to a hydrogen bonding effect. First, raw cotton was used, and the recovery improved significantly between the two lowest energy levels suggesting that washing off the natural finish oils caused the effect. Secondly, adding water, which breaks hydrogen bonds, reduced recovery from 80 to 70%, but insufficient trials were carried out to eliminate lubrication and water/binder interaction effects.

Thus, applicants believe that bond sites are likely composed of three types of bonding:

(1) frictional;

(2) chemical, from the resin; and (3) hydrogen, from the cotton.

A two sample t-test with unequal variance was used to compare two foam binders, Rohm and Haas RHOPLEX® NW-1715 and RHOPLEX® NW-1845, at the intermediate 3600 kJ/kg hydroentanglement energy level. The t tests showed that the two foam binders were not statistically distinguishable for any of the dependent variables tested. Applicants believe that at these low foam binder levels, the modulus of the binder itself is less important than in saturation bonding at the 10% to 20% foam binder level.

Addition of small amounts of binder in foam form involves trading one physical property off against another. In general, adding binder increases break strength, modulus, abrasion resistance, and strain recovery at the expense of fabric stiffness and elongation. The tradeoffs appear particularly interesting for the polyester fabric. Representative property balances for hydroentangled polyester nonwoven fabric are presented in Table III. In this case, hydroentanglement energy can be decreased by a factor of 4 and a satisfactory fabric obtained by adding as little as 1.25% foam binder. Further improved properties can be obtained at the expense of fabric rigidity by increasing either binder or energy.

Similar property balance choices for cotton and acrylic, respectively, are presented in Tables IV and V. Cotton is different in that low levels of binder provide less improvement than with the synthetic fibers. Applicants believe that this difference is caused by hydrogen bonding.

TABLE III

Some Property Balance Choices for Hydroentangled Polyester Nonwoven Fabrics

| | | Tensile Properties | | | Abrasion | | |
|---|---|---|---|---|---|---|---|
| Specific Energy, kJ/kg | % Binder | Break Load N/2.54 cm | Break Elongation % | Load at 5% N/2.54 cm | Resistance cycles to failure | % Strain Recovery | Bending Rigidity mg-cm |
| 7100 | 0 | 48 | 82 | 0.4 | 77 | 78 | 35 |
| 1800 | 1.25 | 40 | 63 | 1.3 | 62 | 73 | 79 |
| 7100 | 1.25 | 61 | 74 | 3.0 | 140 | 77 | 90 |
| 7100 | 5.00 | 64 | 68 | 6.2 | 190 | 86 | 290 |

TABLE IV

Some Property Balance Choices for Hydroentangled Cotton Nonwoven Fabrics

| | | Tensile Properties | | | Abrasion | | |
|---|---|---|---|---|---|---|---|
| Specific Energy, kJ/kg | % Binder | Break Load N/2.54 cm | Break Elongation % | Load at 5% N/2.54 cm | Resistance, cycles to failure | % Strain Recovery | Bending Rigidity mg-cm |
| 7100 | 0 | 23 | 55 | 1.8 | 82 | 80 | 82 |
| 1800 | 1.25 | 7 | 67 | 0.5 | 20 | 71 | 71 |

TABLE IV-continued

Some Property Balance Choices for Hydroentangled Cotton Nonwoven Fabrics

| | | Tensile Properties | | | Abrasion | | |
|---|---|---|---|---|---|---|---|
| Specific Energy, kJ/kg | % Binder | Break Load N/2.54 cm | Break Elongation % | Load at 5% N/2.54 cm | Resistance, cycles to failure | % Strain Recovery | Bending Rigidity mg-cm |
| 7100 | 1.25 | 25 | 55 | 2.4 | 65 | 76 | 120 |
| 7100 | 5.0 | 28 | 51 | 5.0 | 120 | 78 | 170 |

TABLE V

Some Property Balance Choices for Hydroentangled Acrylic Nonwoven Fabrics

| | | Tensile Properties | | | Abrasion | | |
|---|---|---|---|---|---|---|---|
| Specific Energy, kJ/kg | % Binder | Break Load N/2.54 cm | Break Elongation % | Load at 5% N/2.54 cm | Resistance cycles to failure | % Strain Recovery | Bending Rigidity mg-cm |
| 7100 | 0 | 34 | 76 | 0.4 | 35 | 56 | 33 |
| 3600 | 1.25 | 15 | 69 | 1.1 | 39 | 80 | 75 |
| 7100 | 1.25 | 45 | 64 | 1.9 | 67 | — | 75 |
| 7100 | 5.00 | 49 | 57 | 6.4 | 98 | 89 | 300 |

Thus, the addition of binder to hydroentangled fabrics of polyester, cotton, and acrylic significantly increases the break strength, load at 5% strain, abrasion resistance, and strain recovery, but the bending rigidity of the fabric also increases. A synergistic effect of the two bonding mechanisms is greatest in fabrics that are poorly hydroentangled and have no possibility of hydrogen bonding. The effect of foam binder add-on tends to even out with well-hydroentangled and hydrogen bonded fabrics. Fiber properties and type also play a significant role in the hydroentangling process. For example, polyester hydroentangles well while cotton and acrylic do not. The affect of binder choice on the properties was discovered not to be a significant factor at these low add-on levels. Applicants believe that by balancing the tradeoffs between the physical properties as described herein, an improved hydroentangled nonwoven fabric with unique properties can be produced.

It will be understood that various details of the invention may be changed without departing from the scope of the invention. Furthermore, the foregoing description is for the purpose of illustration only, and not for the purpose of limitation--the invention being defined by the claims.

What is claimed is:

1. A method of producing a hydroentangled nonwoven web material with good strength and abrasion resistance while maintaining good fabric aesthetics consisting of:

(a) forming a substrate by carding and cross-lapping fibers wherein the fibers are synthetic and/or natural fibers;

(b) hydroentangling the fibers of said substrate to form a spunlace web;

(c) applying 2.5% or less by weight of said spunlace web of a foamed adhesive binding material to said spunlace web wherein said foamed adhesive binding material includes an effective amount of surfactant to achieve a foam half-life in air of about 4–5 minutes and does not include an anti-foaming agent; and (d) applying a force to said spunlace web to cause said foamed material to be uniformly distributed thereon and to fully penetrate said spunlace web.

2. The method of producing a hydroentangled nonwoven web material according to claim 1, wherein said substrate synthetic and natural fibers are selected from the group consisting of polyester, acrylic and cotton yarns.

3. The method of producing a hydroentangled nonwoven web material according to claim 2, including forming said substrate from 100% of a selected one of said polyester, acrylic and cotton yarns.

4. The method of producing a hydroentangled nonwoven web material according to claim 1, wherein said substrate has a weight of between about 25 to 400 g/m$^2$.

5. The method of producing a hydroentangled nonwoven web material according to claim 4, wherein said substrate has a weight of about 50 g/m$^2$.

6. The method of producing a hydroentangled nonwoven web material according to claim 1, including hydroentangling said fibers of said substrate at an energy level between about 1800 to 7100 kJ/kg.

7. The method of producing a hydroentangled nonwoven web material according to claim 1, wherein said effective amount of said foamed adhesive binding material is about 2.5% by weight of said spunlace web.

8. The method of producing a fiber entangled nonwoven web material according to claim 1, wherein said foamed adhesive binding material is an admixture of water, acrylic binder and a foaming agent.

9. The method of producing a hydroentangled nonwoven web material according to claim 1, including applying said foamed material with a horizontal applicator beneath said spunlace web and providing a roller over said spunlace web and pressing down thereon to force said foamed material to fully penetrate said spunlace web.

10. A method of producing a hydroentangled nonwoven web material with good strength and abrasion resistance while maintaining good fabric aesthetics consisting of:

(a) forming a substrate weighing between about 25 to 400 g/m$^2$ by carding and cross-lapping fibers wherein the fibers are synthetic and/or natural fibers;

(b) hydroentangling the fibers of said substrate at an energy level between about 1800 to 7100 kJ/kg to form a spunlace web;

(c) applying an effective amount of a foamed adhesive binding material to said spunlace web wherein said foamed binding material does not exceed about 2.5% by weight of said spunlace web and wherein said foamed binding material includes an effective amount of surfactant to achieve a foam half-life in air of about 4 to 5 minutes and does not include an anti-foaming agent; and (d) applying a force to said spunlace web to cause said foamed material to be uniformly distributed thereon and to fully penetrate said spunlace web.

11. The method of producing a hydroentangled nonwoven web material according to claim 10, wherein said substrate synthetic and natural fibers are selected from the group consisting of polyester, acrylic and cotton yarns.

12. The method of producing a hydroentangled nonwoven web material according to claim 11, including forming said substrate from 100% of a selected one of said polyester, acrylic and cotton yarns.

13. The method of producing a hydroentangled nonwoven web material according to claim 10, wherein said substrate has a weight of about 50 g/m$^2$.

14. The method of producing a hydroentangled nonwoven web material according to claim 10, wherein said effective amount of said foamed adhesive binding material is about 2.5% by weight of said spunlace web.

15. The method of producing a hydroentangled nonwoven web material according to claim 10, wherein said foamed adhesive binding material is an admixture of water, acrylic binder and a foaming agent.

16. The method of producing a hydroentangled nonwoven web material according to claim 10, including applying said foamed material with a horizontal applicator beneath said spunlace web and providing a roller over said spunlace web and pressing down thereon to force said foamed material to fully penetrate said spunlace web.

17. A method of producing a hydroentangled nonwoven web material with good strength and abrasion resistance while maintaining good fabric aesthetics consisting of:

(a) forming a substrate by carding and cross-lapping fibers wherein the fibers are synthetic and/or natural fibers;

(b) hydroentangling the fibers of said substrate to form a spunlace web;

(c) applying 2.5% or less by weight of said spunlace web of a foamed adhesive binding material to said spunlace web wherein said foamed adhesive binding material includes an effective amount of surfactant to achieve a foam half-life in air of about 4–5 minutes and does not include an anti-foaming agent;

(d) applying a force to said spunlace web to cause said foamed material to be uniformly distributed thereon and to fully penetrate said spunlace web; and (e) drying said treated spunlace web subsequent to (d).

18. A method of producing a hydroentangled nonwoven web material with good strength and abrasion resistance while maintaining good fabric aesthetics consisting of:

(a) forming a substrate by carding and cross-lapping fibers wherein the fibers are synthetic and/or natural fibers;

(b) hydroentangling the fibers of said substrate to form a spunlace web;

(c) applying 2.5% or less by weight of said spunlace web of a foamed adhesive binding material to said spunlace web wherein said foamed adhesive binding material includes an effective amount of surfactant to achieve a foam half-life in air of about 4–5 minutes and does not include an anti-foaming agent;

(d) applying a force to said spunlace web to cause said foamed material to be uniformly distributed thereon and to fully penetrate said spunlace web; and (e) drying said spunlace web subsequent to both (b) and (d).

19. A method of producing a hydroentangled nonwoven web material with good strength and abrasion resistance while maintaining good fabric aesthetics consisting of:

(a) forming a substrate weighing between about 25 to 400 g/m$^2$ by carding and cross-lapping fibers wherein the fibers are synthetic and/or natural fibers;

(b) hydroentangling the fibers of said substrate at an energy level between about 1800 to 7100 kJ/kg to form a spunlace web;

(c) applying an effective amount of a foamed adhesive binding material to said spunlace web wherein said foamed binding material does not exceed about 2.5% by weight of said spunlace web and wherein said foamed binding material includes an effective amount of surfactant to achieve a foam half-life in air of about 4 to 5 minutes and does not include an anti-foaming agent;

(d) applying a force to said spunlace web to cause said foamed material to be uniformly distributed thereon and to fully penetrate said spunlace web; and (e) drying said treated spunlace web subsequent to (d).

20. A method of producing a hydroentangled nonwoven web material with good strength and abrasion resistance while maintaining good fabric aesthetics consisting of:

(a) forming a substrate weighing between about 25 to 400 g/m$^2$ by carding and cross-lapping fibers wherein the fibers are synthetic and/or natural fibers;

(b) hydroentangling the fibers of said substrate at an energy level between about 1800 to 7100 kJ/kg to form a spunlace web;

(c) applying an effective amount of a foamed adhesive binding material to said spunlace web wherein said foamed binding material does not exceed about 2.5% by weight of said spunlace web and wherein said foamed binding material includes an effective amount of surfactant to achieve a foam half-life in air of about 4 to 5 minutes and does not include an anti-foaming agent;

(d) applying a force to said spunlace web to cause said foamed material to be uniformly distributed thereon and to fully penetrate said spunlace web; and (e) drying said spunlace web subsequent to both (b) and (d).

* * * * *